US012714204B2

(12) United States Patent
Ringholz et al.

(10) Patent No.: US 12,714,204 B2
(45) Date of Patent: Aug. 25, 2026

(54) FOOTWEAR CLOSURE SYSTEM

(71) Applicant: Plae Co., Honolulu, HI (US)

(72) Inventors: Ryan Ringholz, Honolulu, HI (US); Hung-Chia Lin, Tainan City (TW)

(73) Assignee: Plae Co., Honolulu, HI (US)

( * ) Notice: Subject to any disclaimer, the term of this patent is extended or adjusted under 35 U.S.C. 154(b) by 0 days.

(21) Appl. No.: 18/368,383

(22) Filed: Sep. 14, 2023

(65) Prior Publication Data

US 2024/0000191 A1 Jan. 4, 2024

Related U.S. Application Data

(62) Division of application No. 15/336,094, filed on Oct. 27, 2016, now Pat. No. 11,812,824.

(Continued)

(51) Int. Cl.
*A43C 1/06* (2006.01)
*A43C 1/00* (2006.01)

(Continued)

(52) U.S. Cl.
CPC ..... *A43C 1/06* (2013.01); *A43C 1/006* (2013.01); *A43C 1/02* (2013.01); *A43C 5/00* (2013.01);

(Continued)

(58) Field of Classification Search
CPC .... A43C 1/00; A43C 1/02; A43C 1/06; A43C 1/04; A43C 5/00; A43C 7/00; A43C 7/02;

(Continued)

(56) References Cited

U.S. PATENT DOCUMENTS 124,512 A * 3/1872 Rand ..... A43C 1/00 24/713.4
157,972 A * 12/1874 Pruett ..... A43C 1/00 24/712

(Continued)

FOREIGN PATENT DOCUMENTS

DE 20102157 U1 9/1959
DE 4024782 A1 6/1991

(Continued)

OTHER PUBLICATIONS

Extended European Search Report (eESR) issued in EP16860794.3, dated Aug. 1, 2019.

(Continued)

*Primary Examiner* — Aiying Zhao
(74) *Attorney, Agent, or Firm* — Hansen IP Law PLLC

(57) ABSTRACT

A closure system for a shoe includes a single shoelace which can be secured and tightened through the use of one hand. The shoe includes a button around which the shoelace is wrapped to facilitate easy removal of the shoe. In one embodiment one end of the shoelace is secured under the upper of the shoe near the toe and a second end of the shoelace is secured in a slider that is slidably mounted on the rear of the shoe to provide micro-adjustments of the tightness of the shoe. Alternatively, the shoe includes a strip of piping around the rear of the shoe and a slider in which the second end of the shoelace is secured slides along the piping when the user wants to make micro-adjustments. The adjustment of the tightness of the shoe can also be made by sliding a barrel that is located over the top of the tongue.

10 Claims, 26 Drawing Sheets

Related U.S. Application Data

(60) Provisional application No. 62/298,712, filed on Feb. 23, 2016, provisional application No. 62/246,742, filed on Oct. 27, 2015.

(51) Int. Cl.

| | |
|---|---|
| ***A43C 1/02*** | (2006.01) |
| ***A43C 5/00*** | (2006.01) |
| ***A43C 7/00*** | (2006.01) |
| ***A43C 9/02*** | (2006.01) |
| ***A43C 11/00*** | (2006.01) |

(52) U.S. Cl.
CPC ..... *A43C 7/00* (2013.01); *A43C 9/02* (2013.01); *A43C 11/008* (2013.01)

(58) Field of Classification Search
CPC ..... A43C 9/02; A43C 11/004; A43C 11/008; A43C 11/12
See application file for complete search history.

(56) References Cited

U.S. PATENT DOCUMENTS

| | | | | | |
|---|---|---|---|---|---|
| 440,806 | A | | 11/1890 | Griffin | |
| 733,001 | A | * | 7/1903 | Bryant | A43C 7/00 24/712.9 |
| 1,088,067 | A | * | 2/1914 | Forbes | A43C 1/00 24/713.6 |
| 1,385,362 | A | | 7/1921 | Coombs | |
| 1,715,247 | A | | 5/1929 | Reeves | |
| 2,004,702 | A | * | 6/1935 | Luttmann, Jr. | A43C 1/02 24/30.5 P |
| 2,901,796 | A | | 9/1959 | Hope | |
| 2,961,727 | A | | 11/1960 | Coffey | |
| 3,701,572 | A | | 10/1972 | Velasquez | |
| 4,999,889 | A | * | 3/1991 | LeCouturer | A43C 1/06 24/713.2 |
| 5,016,327 | A | | 5/1991 | Klausner | |
| 5,129,130 | A | * | 7/1992 | Lecouturier | A43C 7/00 24/713.2 |
| 5,463,822 | A | | 11/1995 | Miller | |
| 5,471,769 | A | | 12/1995 | Sink | |
| 5,537,763 | A | | 7/1996 | Donnadieu et al. | |
| 5,873,183 | A | * | 2/1999 | Posner | A43C 7/00 24/712 |
| 6,032,387 | A | | 3/2000 | Johnson | |
| 7,168,190 | B1 | | 1/2007 | Gillespie | |
| 7,721,468 | B1 | | 5/2010 | Johnson et al. | |
| 8,201,346 | B2 | | 6/2012 | Darby, II et al. | |
| 2001/0025434 | A1 | | 10/2001 | Fellouhe | |
| 2005/0060912 | A1 | | 3/2005 | Holzer et al. | |
| 2005/0126043 | A1 | | 6/2005 | Reagan et al. | |
| 2006/0156517 | A1 | | 7/2006 | Hammerslag et al. | |
| 2006/0254089 | A1 | | 11/2006 | Frydlewski | |
| 2007/0011910 | A1 | | 1/2007 | Keen | |
| 2007/0068040 | A1 | | 3/2007 | Farys | |
| 2007/0169378 | A1 | | 7/2007 | Soderberg et al. | |
| 2008/0060167 | A1 | | 3/2008 | Hammerslag et al. | |
| 2008/0066346 | A1 | | 3/2008 | Hammerslag et al. | |
| 2008/0172848 | A1 | | 7/2008 | Chen | |
| 2009/0100717 | A1 | | 4/2009 | Cabanis | |
| 2010/0101061 | A1 | | 4/2010 | Ha | |
| 2010/0101114 | A1 | | 4/2010 | Reagan et al. | |
| 2010/0139057 | A1 | | 6/2010 | Soderberg et al. | |
| 2010/0175278 | A1 | | 7/2010 | Seliger | |
| 2010/0319216 | A1 | | 12/2010 | Grenzke et al. | |
| 2011/0099843 | A1 | | 5/2011 | Jung | |
| 2011/0225843 | A1 | | 9/2011 | Kerns et al. | |
| 2012/0017469 | A1 | | 1/2012 | Kishino | |
| 2012/0144700 | A1 | * | 6/2012 | Zhao | A43C 1/00 36/99 |
| 2012/0240428 | A1 | | 9/2012 | Knoll | |
| 2013/0091731 | A1 | | 4/2013 | Wang | |
| 2013/0092780 | A1 | | 4/2013 | Soderberg et al. | |
| 2013/0269219 | A1 | | 10/2013 | Burns et al. | |
| 2014/0007391 | A1 | * | 1/2014 | Siegfreid | A43C 7/00 24/713 |
| 2014/0123449 | A1 | | 5/2014 | Soderberg et al. | |
| 2014/0157627 | A1 | | 6/2014 | Smaldone et al. | |
| 2014/0196312 | A1 | | 7/2014 | Sakaue et al. | |
| 2014/0208550 | A1 | | 7/2014 | Neiley | |
| 2014/0290016 | A1 | | 10/2014 | Lovett et al. | |
| 2014/0366340 | A1 | | 12/2014 | Park et al. | |
| 2015/0007422 | A1 | | 1/2015 | Cavanagh et al. | |
| 2015/0059206 | A1 | | 3/2015 | Lovett et al. | |
| 2015/0076272 | A1 | | 3/2015 | Trudel et al. | |
| 2015/0257489 | A1 | | 9/2015 | Trudel | |
| 2015/0289595 | A1 | | 10/2015 | Rushbrook et al. | |
| 2015/0289609 | A1 | | 10/2015 | Gittens et al. | |

FOREIGN PATENT DOCUMENTS

| | | | |
|---|---|---|---|
| FR | 2891602 | A1 | 10/2005 |
| JP | 2001017207 | A | 1/2001 |
| JP | 2005058301 | A | 3/2005 |
| JP | 3115694 | U | 11/2005 |
| WO | 2010030066 | A1 | 3/2010 |

OTHER PUBLICATIONS

International Search Report and Written Opinion issued in PCT/US2016/059136, dated Mar. 23, 2017.
English translation for FR2891602 from Patent Translate, Powered by EPO and Google.
English translation for DE20102157U1 from Patent Translate, Powered by EPO and Google.
Justin, "Sensori Venture Xero Shoes (P)review!", http://birthdayshoes.com/sensori-venture-xeroshoes-p-review accessed Dec. 20, 2016, pp. 1-11.
English translation for WO2010030066A1 from Patent Translate, Powered by EPO and Google.
Office Action for Japanese Patent Application No. 2023-218874 dated Mar. 11, 2025.
English translation of Office Action for Japanese Patent Application No. 2023-218874 dated Mar. 11, 2025.
English translation of DE4024782 from Total Patent One.
English translation of JP3115694 from Total Patent One.
English translation of JP2001017207 from Total Patent One.
English translation of JP2005058301 from Total Patent One.

* cited by examiner

FOOTWEAR CLOSURE SYSTEM

CROSS-REFERENCE TO RELATED APPLICATIONS

This application is a divisional of U.S. patent application Ser. No. 15/336,094, filed on Oct. 27, 2016, which claims the benefit of Provisional Patent Application No. 62/298,712, titled "FOOTWEAR CLOSURE SYSTEM," which was filed on Feb. 23, 2016 and U.S. Provisional Patent Application No. 62/246,742, titled "SHOE CLOSURE SYSTEM," which was filed on Oct. 27, 2015, the entirety of each of which is hereby incorporated by reference.

BACKGROUND OF THE INVENTION

This invention relates to shoes and a shoelace system for tightening a shoe on a user's foot.

Many shoes currently sold on the market include shoelaces. Shoelaces must be generally tied with two hands and the person tying the shoes must have some dexterity and coordination to be able to tie a bow in the shoe. For this reason, it is not only very difficult for children to tie shoelaces but it is also difficult for certain physically disabled people, especially individuals who only have the use of one hand. Often such individuals are forced to wear loafers or other shoes that are more easily closed than shoes with shoelaces.

Shoes often become untied because of the pressure placed on the bow by the constant movement of the tongue caused by the instep. Such movement often causes a loosening of the bow, thereby causing shoes to become untied, which then requires retying of the shoelaces. Wearers of such shoes are routinely concerned about their shoes becoming untied.

Often when a person is wearing a shoe, the initial adjustment changes as feet tend to swell, thereby making the shoe tighter. Users also often like to change the tension on the closure system of a shoe depending upon the activity in which they are engaging. For these reasons, it is desirable to provide the ability for a wearer to make micro adjustments in a shoe that would allow for small amounts of loosening or tightening of the shoe closure system.

It is, therefore, a principal object of the present invention to provide a shoe with an improved shoelace closure system.

Another object of the present invention is to provide a shoelace closure system that can easily be tightened with one hand and that enables the user to make micro adjustments.

Still another object of the present invention is to provide a shoelace closure system that resists becoming unintentionally untied.

SUMMARY OF INVENTION

The closure system for a shoe of the present invention includes a single shoelace which can be secured and tightened through the use of one hand. The shoe includes a button around which the shoelace is wrapped to facilitate easy removal of the shoe. In one embodiment one end of the shoelace is secured under the upper of the shoe near the toe and a second end of the shoelace is secured in a slider that is slidably mounted on the rear of the shoe to provide micro-adjustments of the tightness of the shoe. In another embodiment, the shoe includes a strip of piping around the rear of the shoe and a slider in which the second end of the shoelace is secured slides along the piping when the user wants to make micro-adjustments. In still another embodiment, the adjustment of the tightness of the shoe is made by sliding a barrel that is located over the top of the tongue of the shoe near location where the user's foot is inserted into the shoe. The button around which the shoelace is fastened is removable to change the look of the shoe.

These are the features and objects of the present invention will be more fully understood from the following detailed description which should be read in light of the accompanying drawings, in which corresponding reference numerals refer to corresponding parts throughout the several views.

DETAILED DESCRIPTION

Figure 1:
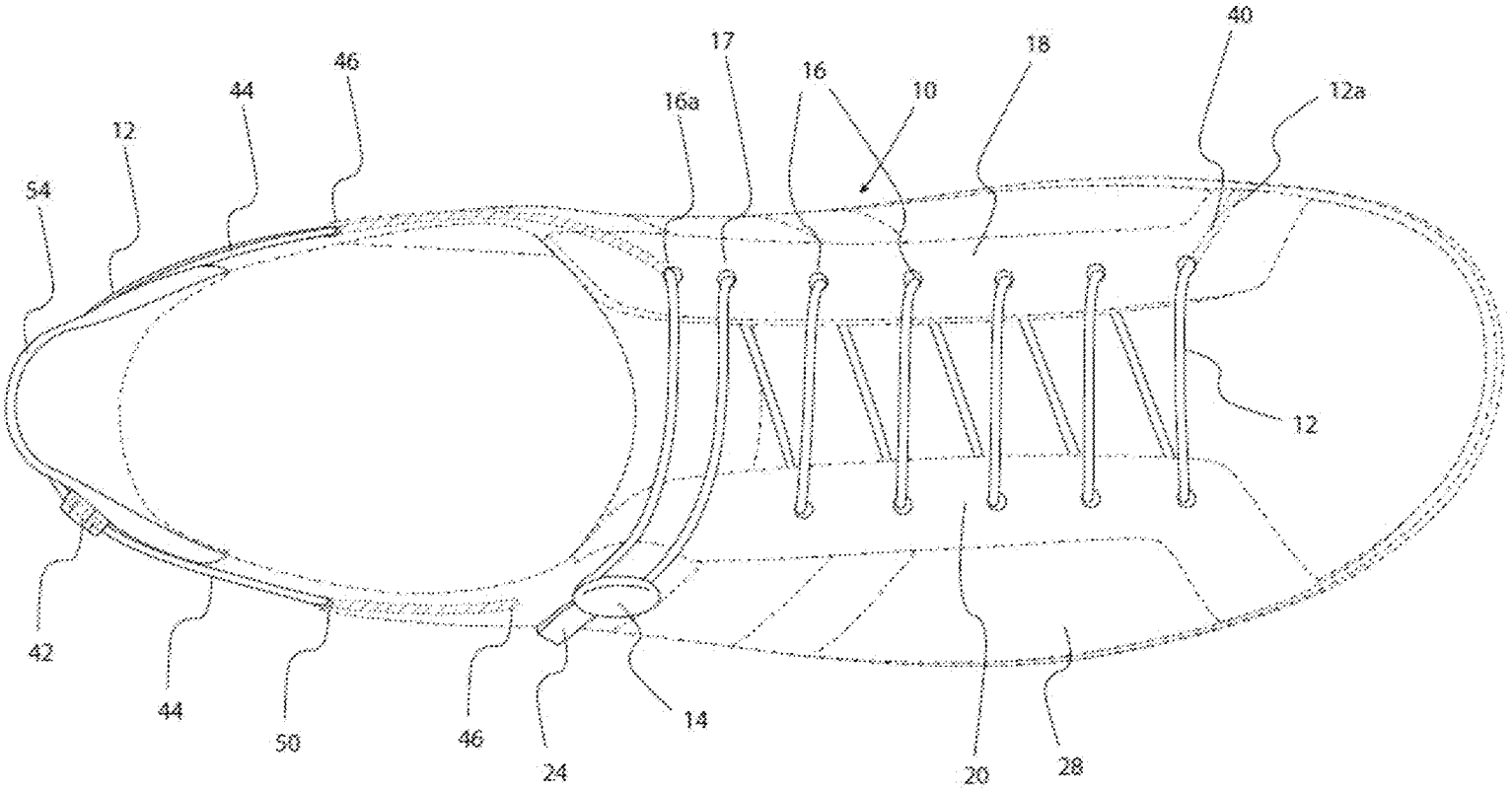
FIG. 1 is a top view of a shoe utilizing an embodiment of the closure system of the present invention.

Referring to FIGS. 1-8 one embodiment of the closure system of the present invention for a shoe 10 is shown in which the closure system includes single shoelace 12. The shoelace 12 is a single strand. One end 12*a* of shoelace 12 is secured to a shoe under flap 18 at location 40 on the medial side of the shoe 10. The shoelace 12 can be either stitched to upper 18 or glued to the upper at location 40.

Figure 1A:
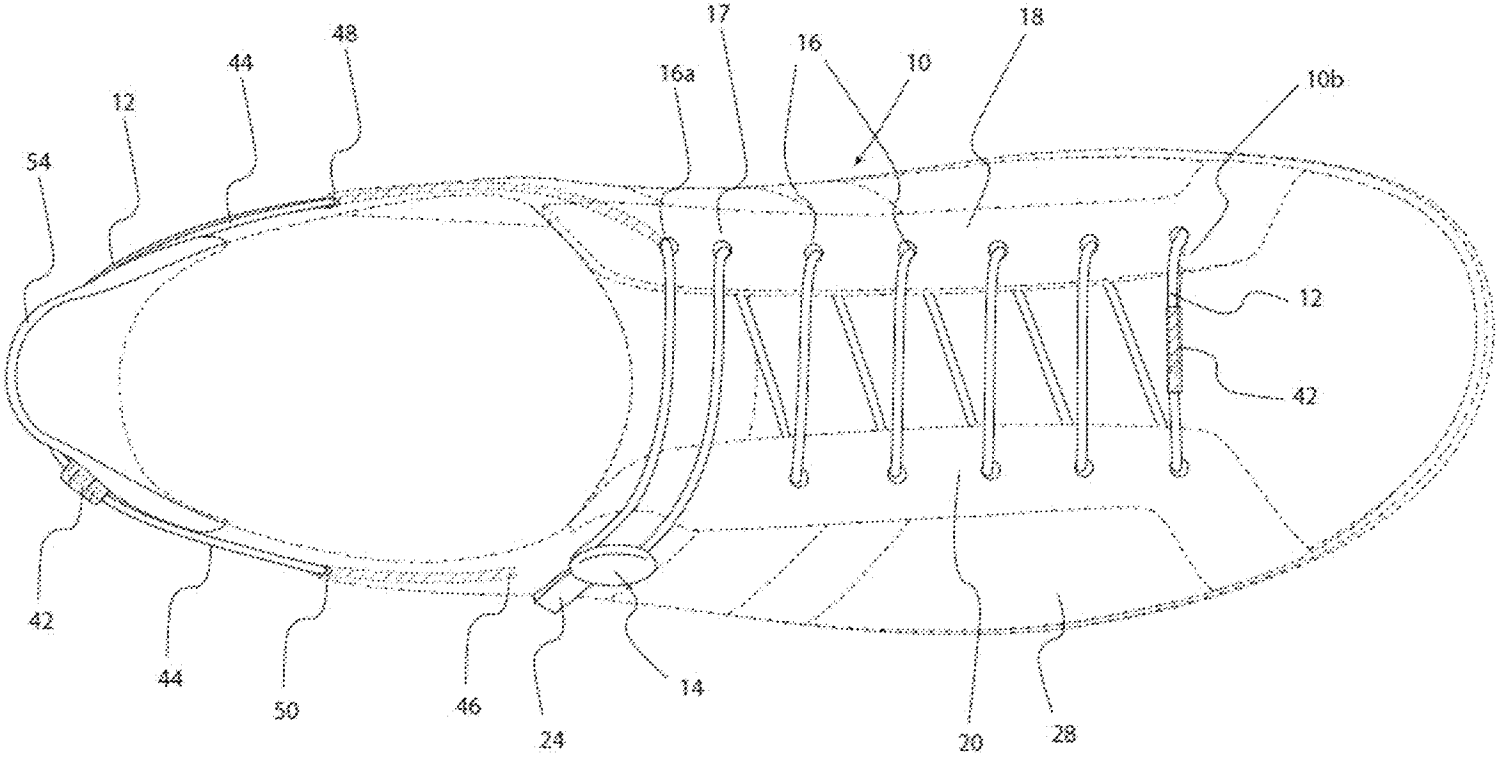
FIG. 1A is a top view of a shoe utilizing another alternative of embodiment of the closure system shown in FIG. 1.
Figure 2:
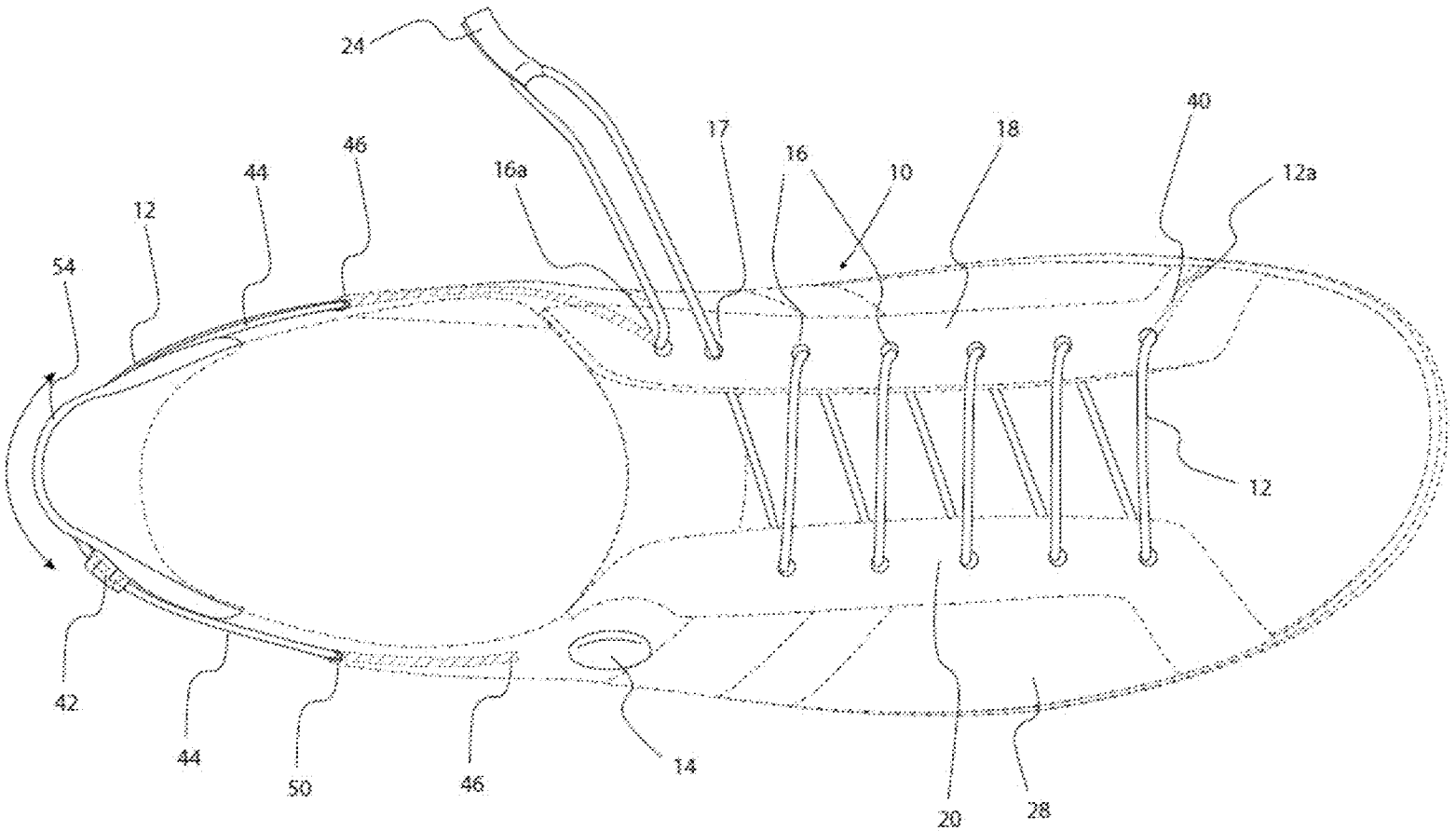
FIG. 2 is a top view of a shoe utilizing an alternative closure system shown in FIG. 1 in which shoelace is untied.
Figure 3:
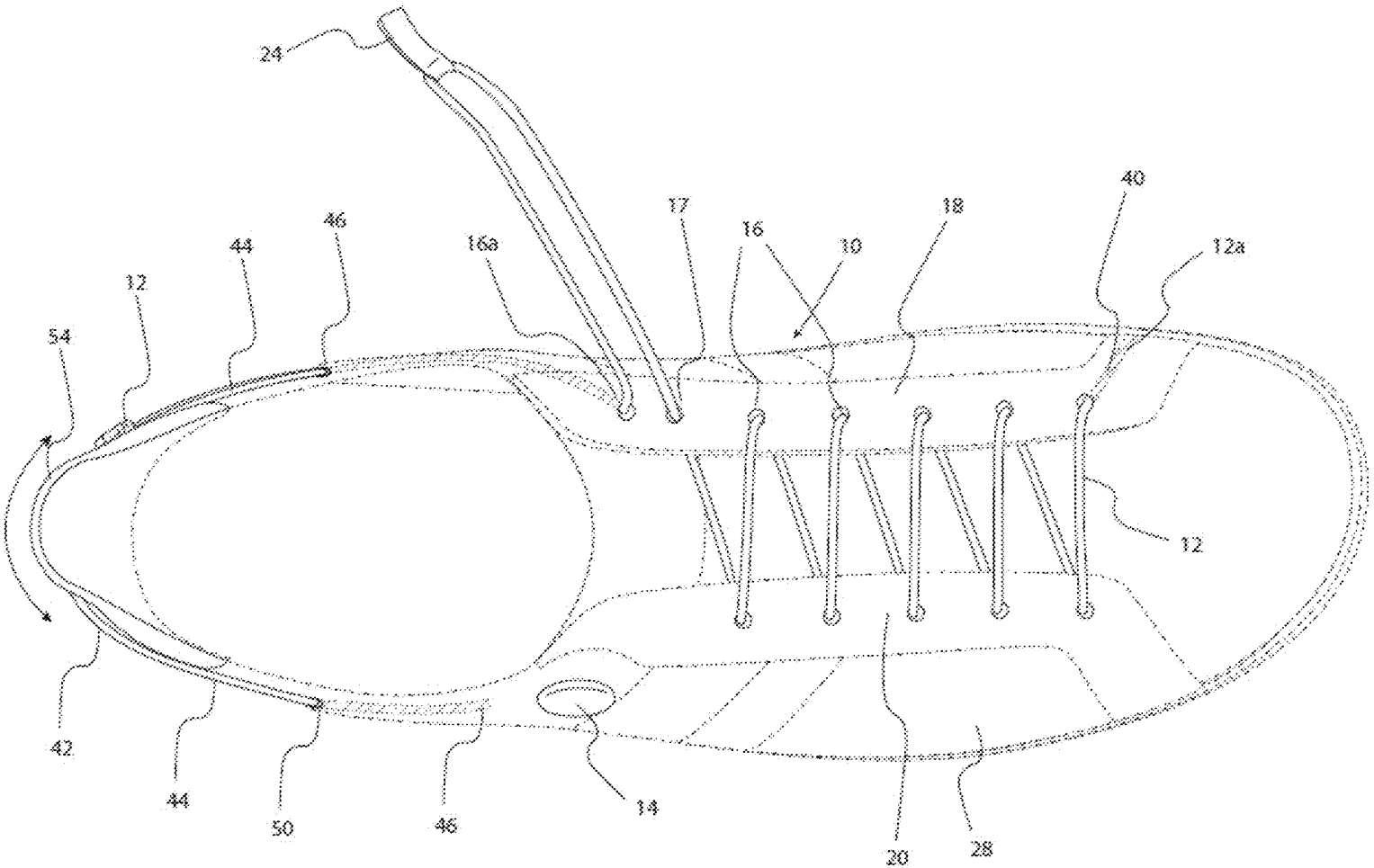
FIG. 3 is a top view of the shoe shown in FIG. 1 with the slider adjusted from the location in FIG. 2.
Figure 4:
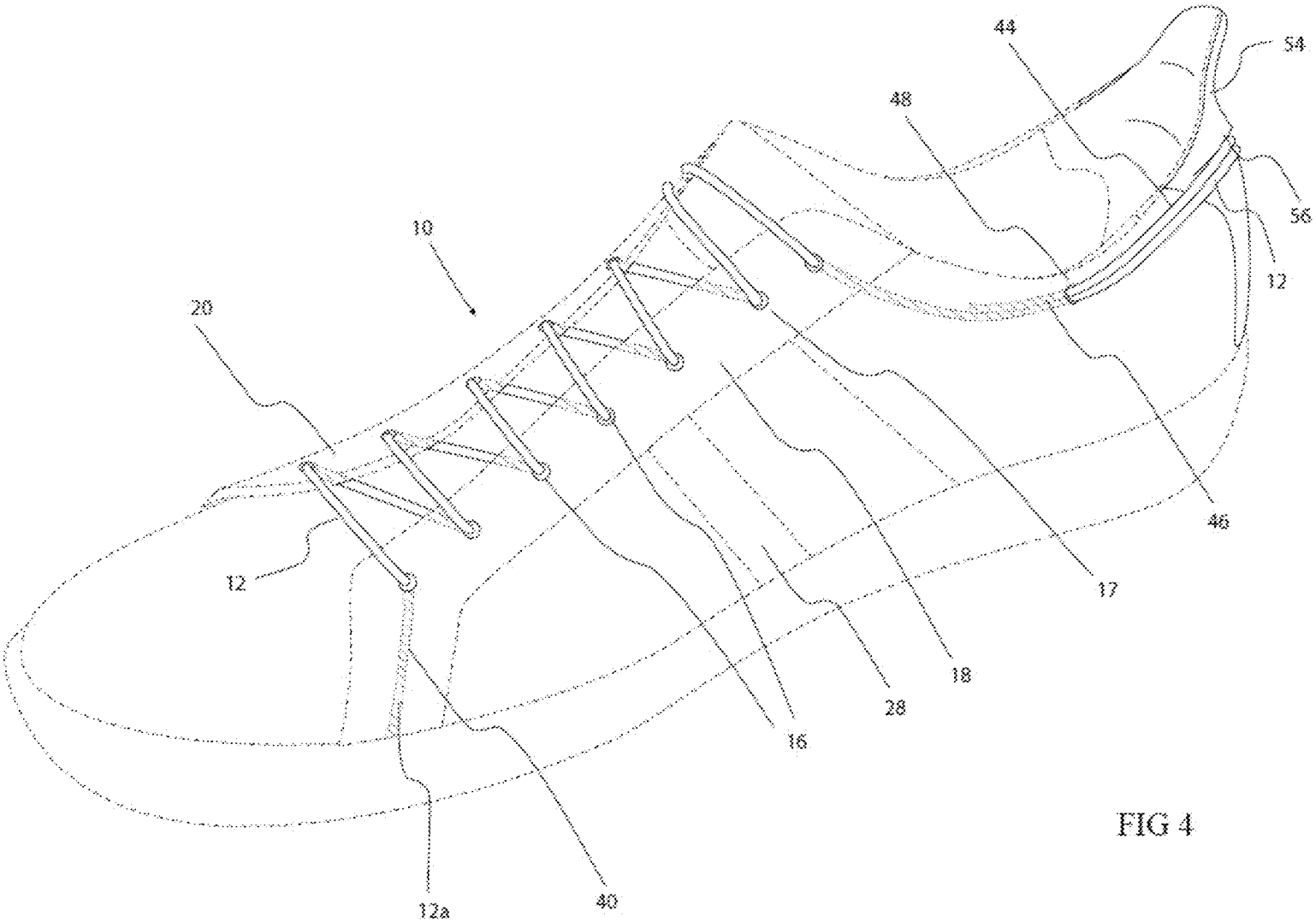
FIG. 4 is a medial side perspective view of the shoe shown in FIG. 2.
Figure 5:
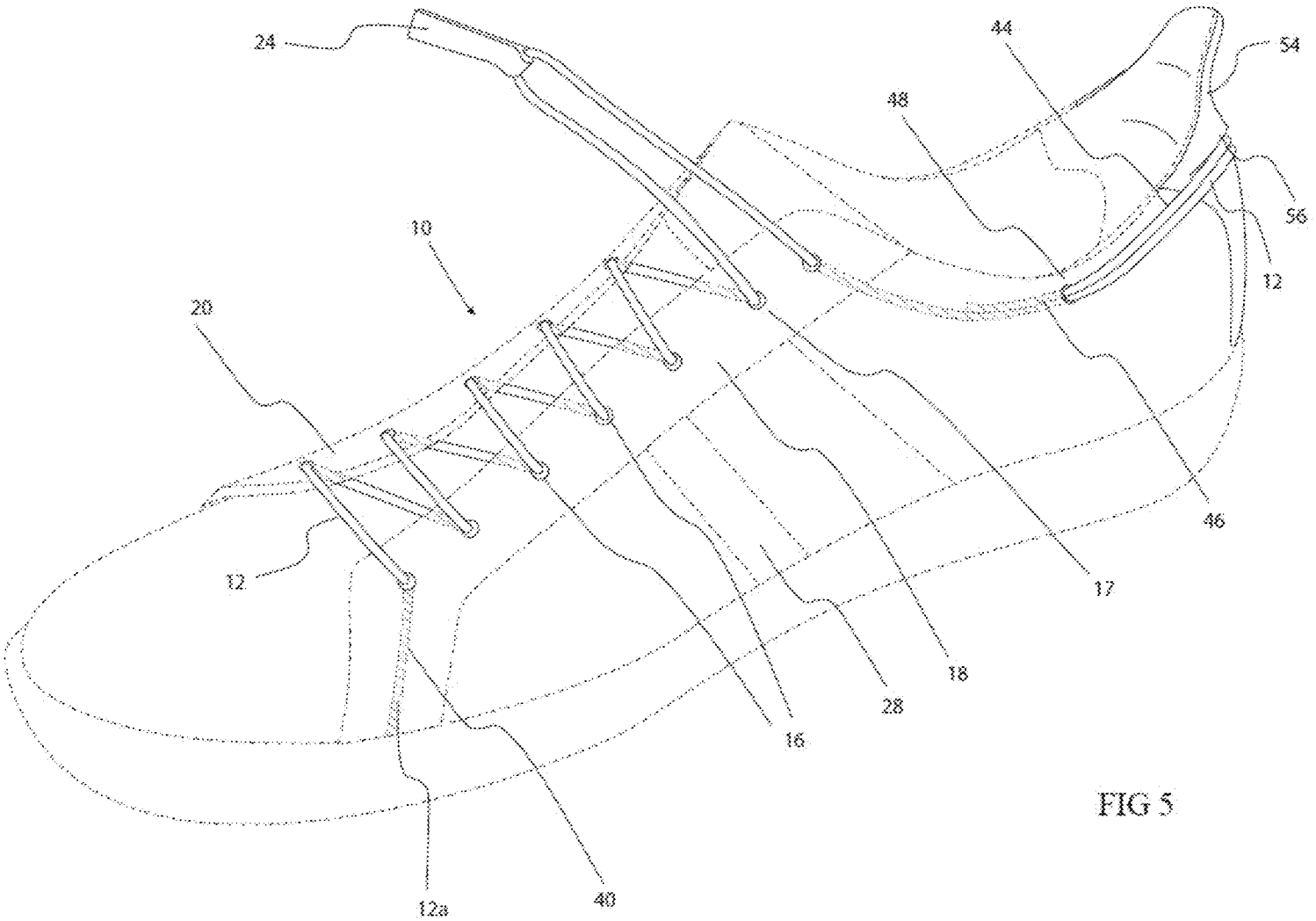
FIG. 5 is a medial side perspective view of the shoe shown in FIG. 1 with the shoelace in an unsecured position.
Figure 6:
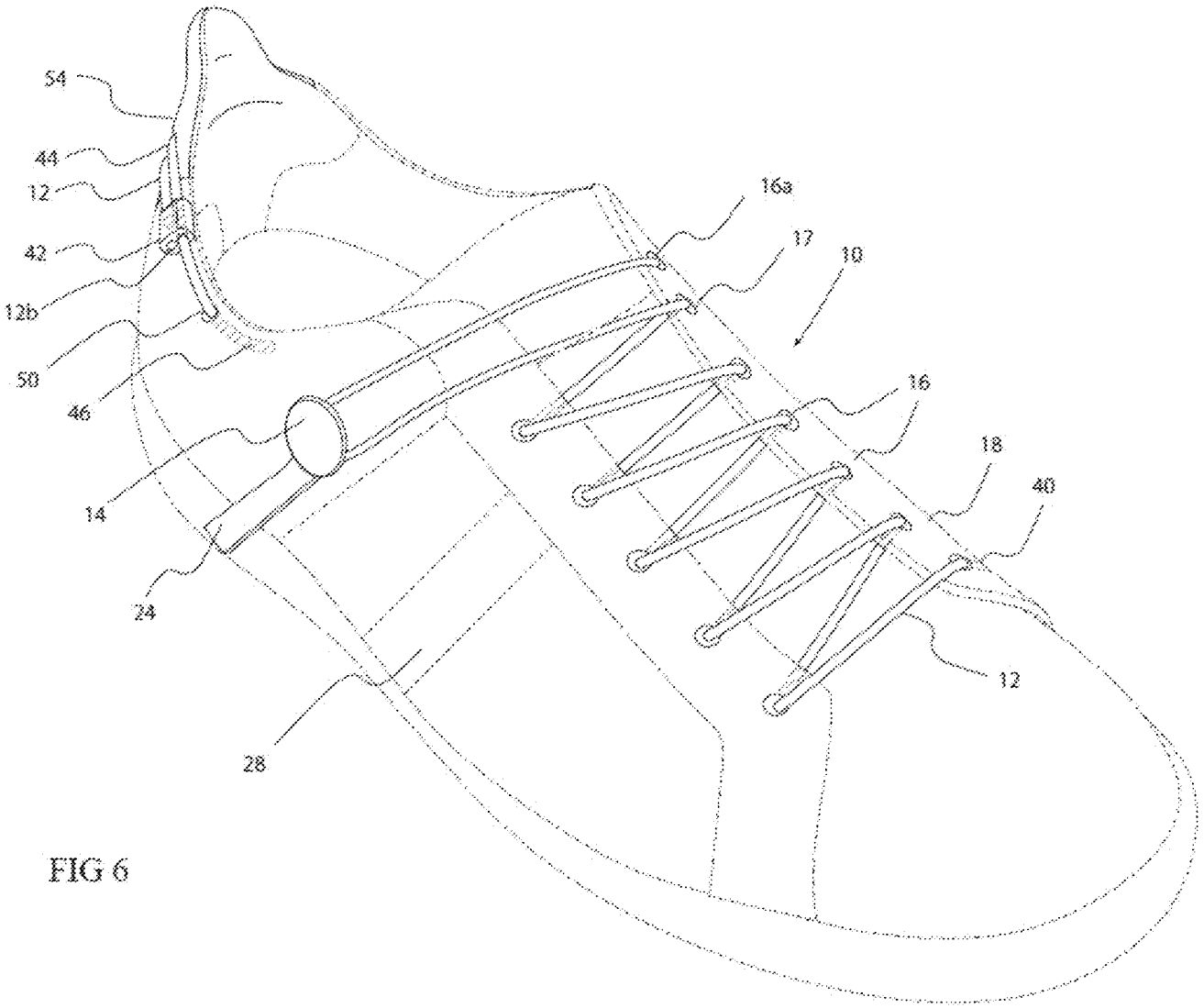
FIG. 6 is a lateral side perspective view of the shoe shown in FIG. 1 with a lace in a secured position.

In the alternate embodiment shown in FIG. 1A, the shoelace 12 is secured to the shoe 10 by being crimped to itself at crimped portion 42.

The shoelace 12 is threaded alternately through eyelets 16 from location 40 back towards the opening in the shoe where the user's foot inserted. A shoelace pull 24 is secured to the shoelace 12 that is in a position on the shoelace 12 after the shoelace passes through the second to last eyelet 17. The shoelace pull 24 is secured to the shoelace 12 to facilitate the pulling of the shoelace 12 over button 14.

Figure 12B:
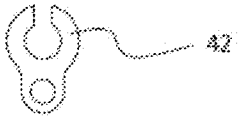
FIG. 12B is an elevational view of a slider utilized in the closure system of FIG. 13.
Figure 12A:
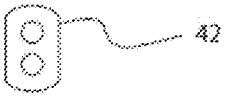
FIG. 12A is an elevational view of a slider utilized in the closure system of FIG. 1.

A second end 12*b* (best shown in FIGS. 6-8) of shoelace 12 is secured to a slider 42 but any known securing means such as stitching or glue. A cross section of the slider utilized in this embodiment is shown in FIG. 12A. A cord 44 is secured along each side of the opening of the shoe where the user inserts his or her foot and around the rear of the shoe. This cord 44 can be either stitched or glued to the interior of the shoe at locations 46 on each side of the shoe 10. The slider 42 is mounted on cord 44 and will side around the rear of the shoe on cord 44. Both the shoelace 12 and the cord 44 will pass from under the upper 28 on the medial side of the shoe 10 through opening 48 along the medial side of the shoe 10. Both the shoelace 12 and the cord 44 extend out of opening 48 around the rear of the shoe. The cord 44 is then inserted through opening 50 on the lateral side of the shoe where the cord 44 is secured inside the shoe 10 under the upper 28 either by glue, stitching or other appropriate securing method.

Figure 7:
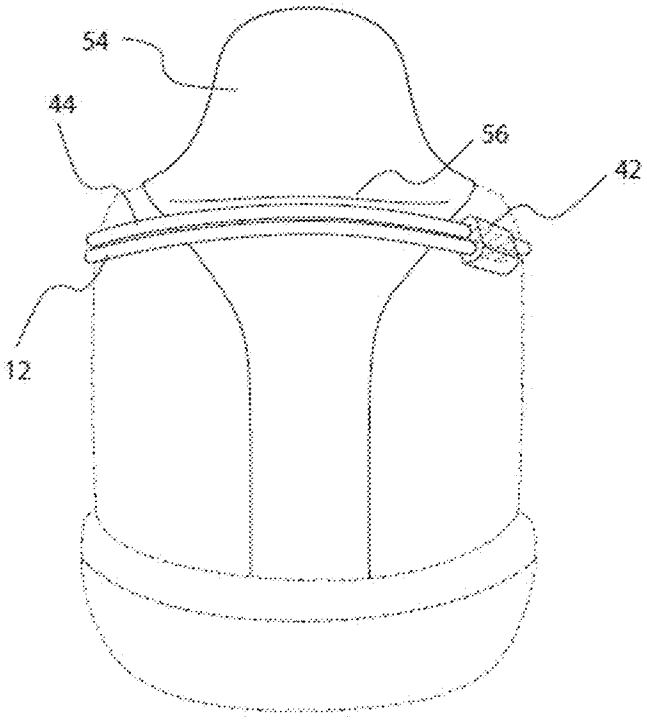
FIG. 7 is a rear elevational view of the shoe shown in FIG. 1.

To adjust the tightening of the shoelace 12 on the shoe 10, the slider 42 is slid along cord 44 thereby pulling the shoelace 12 with it. As the slider 42 is pulled around the shoe from the medial to the lateral side the shoelace 12 is tightened when the slider 42 is moved from the lateral side to the medial side of the shoe as shown in FIG. 7 (compared to FIG. 8), the shoelace 12 is loosened as more slack in the shoelace 12 is provided. The slider 42 is pressure fit on cord 44 so that the slider 42 remains in place after the slider 42 is moved around the shoelace 12. The direction of the movement of the slider 42 is indicated by arrow 52 in FIG. 8.

Figure 8:
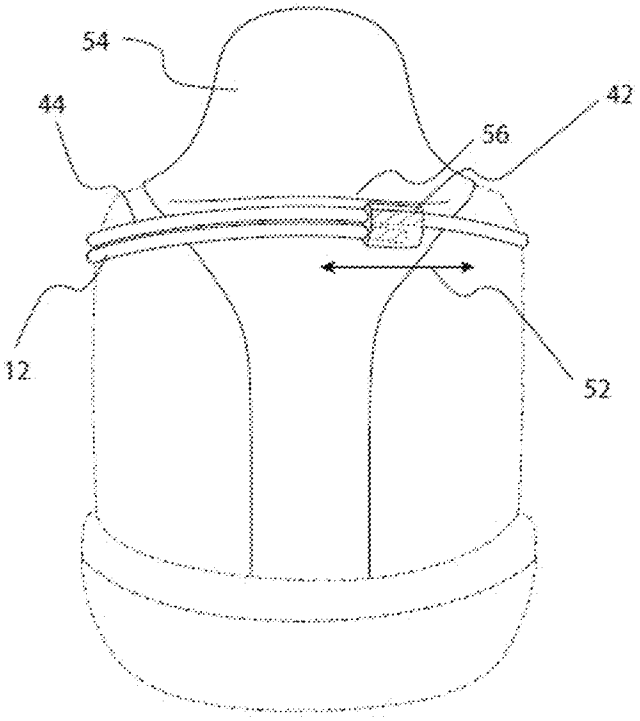
FIG. 8 is a rear elevational view of the shoe shown in FIG. 1 showing a slider adjustment.

As shown most clearly in FIGS. 7 and 8, a heal tab 54 includes a molded ridge 56 which provides a track for shoelace 12 and cord 44 to prevent the shoelace 12 and cord 44 from sliding up the heal tab 54 and causing irritation on the wear's ankle/Achilles.

Figure 9:
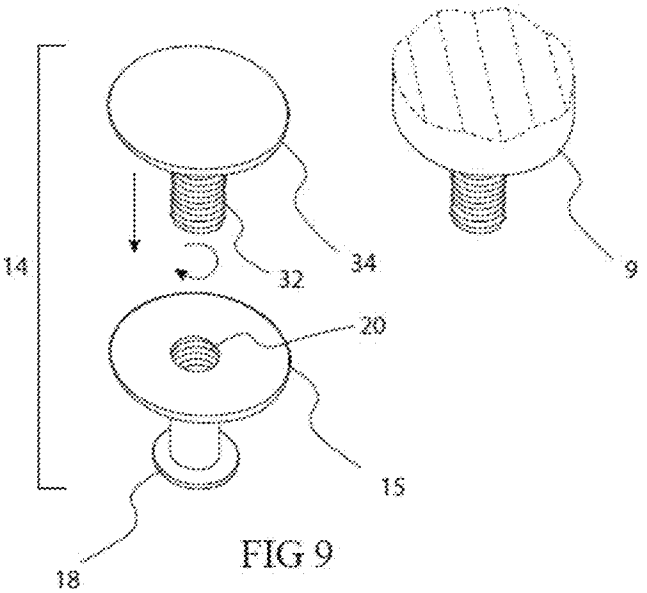
FIG. 9 is an exploded perspective view of the button used in the closure system of FIG. 1.
Figure 10:
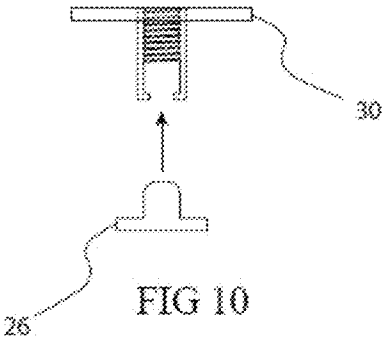
FIG. 10 is a side view of the button used in the closure system of FIG. 1 prior to assembly.
Figure 11:
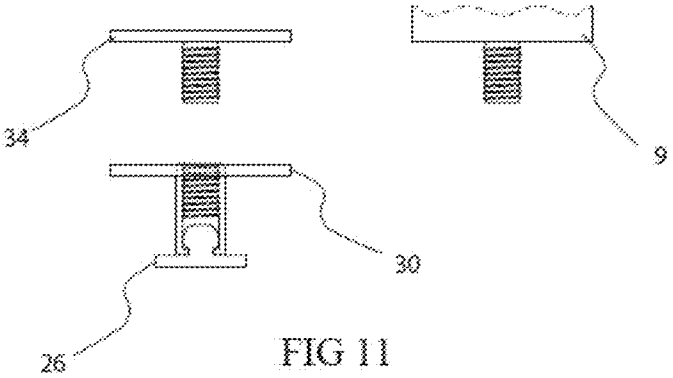
FIG. 11 is a side view of the button used in the closure system of FIG. 1 after the button is assembled.

The button 14 is designed to be removable to change the aesthetic look of the shoe 10. Referring to FIGS. 9-11, a rivet 26 is inserted through the upper 28 on the lateral side of the shoe 10 so that the base of the rivet 26 lies under the upper 28. A base button 30 is fitted to the rivet 26 so that the top surface of the base button 30 is above the exterior surface of the upper 28 and the barrel of the base button 30 passes through the upper 28. Base button 30 includes a hollow threaded post (female) 31 that will receive the solid (male) threaded post 32 of the top button 34 of the button 14. It is anticipated that top button 34 will have alternate designs to change the aesthetic appearance of the shoe 10. For example, the top button 34 could be provided in different colors, shapes, topography, graphics or materials, which would be changed in a manner similar to cufflinks but instead used on shoes. The interchangeability of top button 34 would certainly provide a unique option for identification, self-expression, or complementing ones wardrobe. Button 9 in FIGS. 9 and 11 is another example of button 14 with a different topography. The button could also include a wearable device or other electronic device that provides functions such as motion/step tracking, GPS, Bluetooth, etc.

Turning to the alternative embodiment shown in FIGS. 13-20, the construction of the shoe 10 is nearly identical to the shoe shown in FIGS. 1-8 except that instead of including the cord 44 in the embodiment of FIGS. 1-8, piping 58 is positioned around the rear of the shoe 10. In the embodiment of FIGS. 13-20, the slider 44 will slide along the piping 58 instead of riding along cord 44 as shown in the embodiment of FIGS. 1-8.

Figure 13:
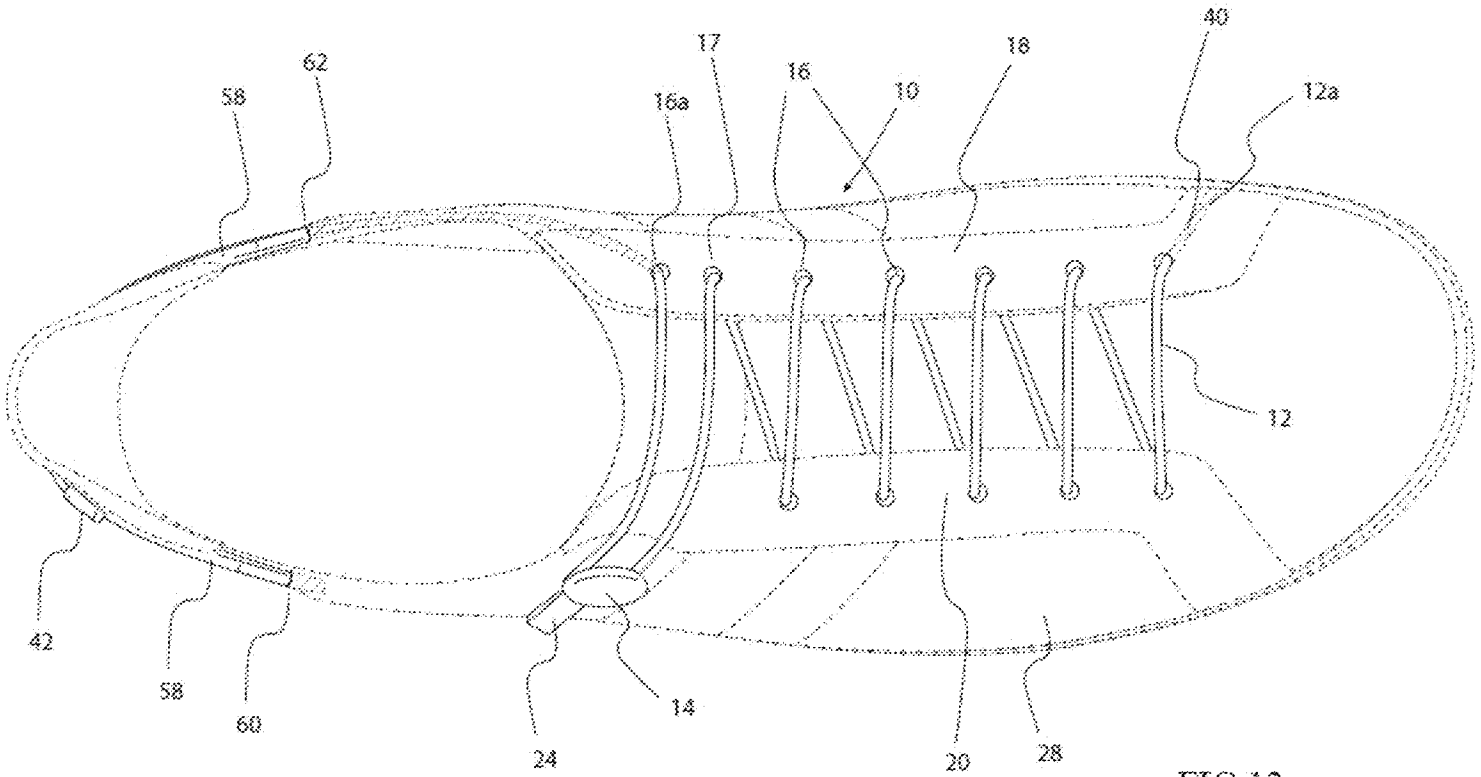
FIG. 13 is a top view of a shoe utilizing an alternate embodiment of the closure system of the present invention with the shoelace in a secured position.
Figure 13A:
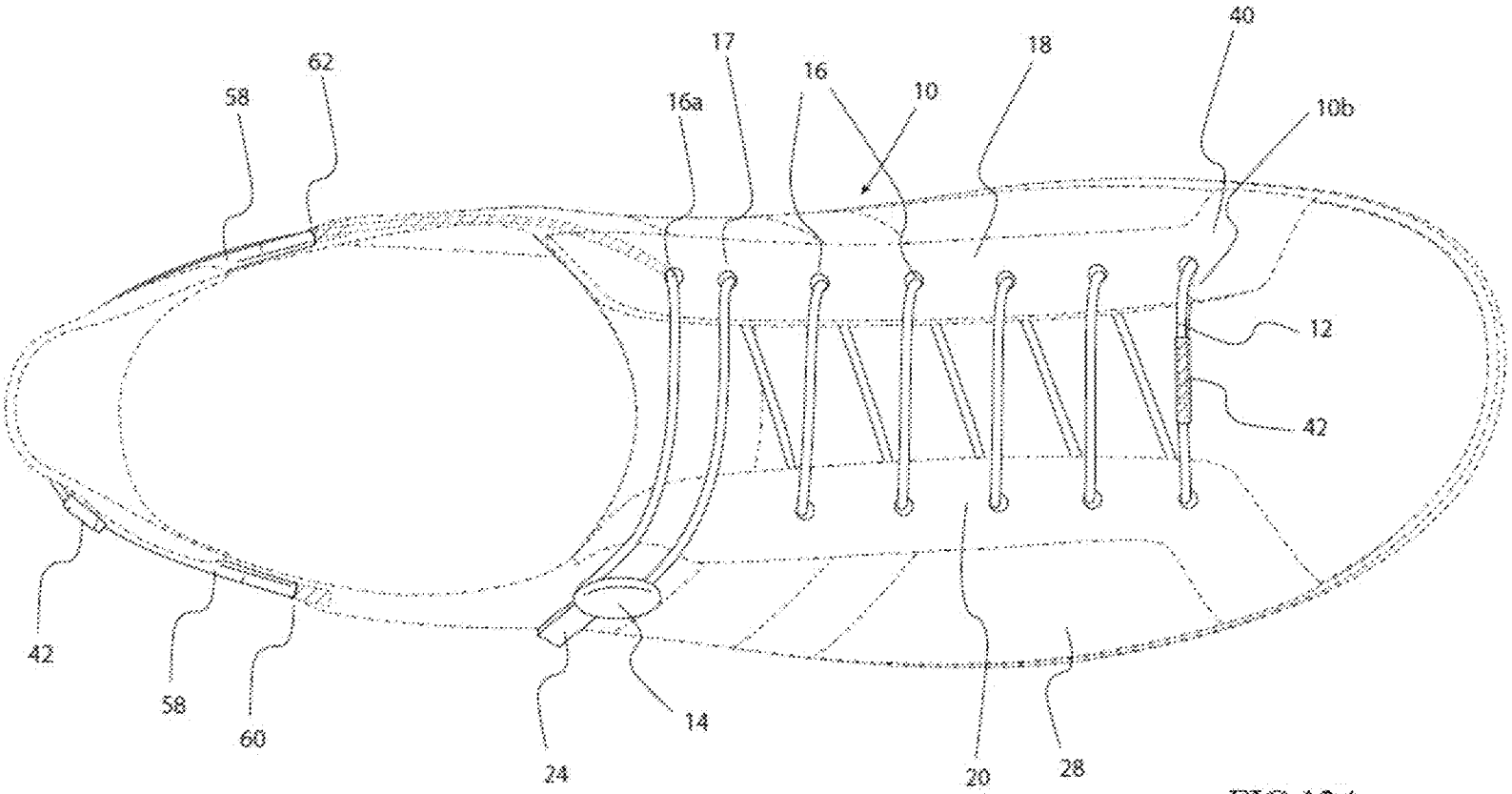
FIG. 13A is a top view of a shoe utilizing another alternative embodiment of the closure system shown in FIG. 13.
Figure 14:
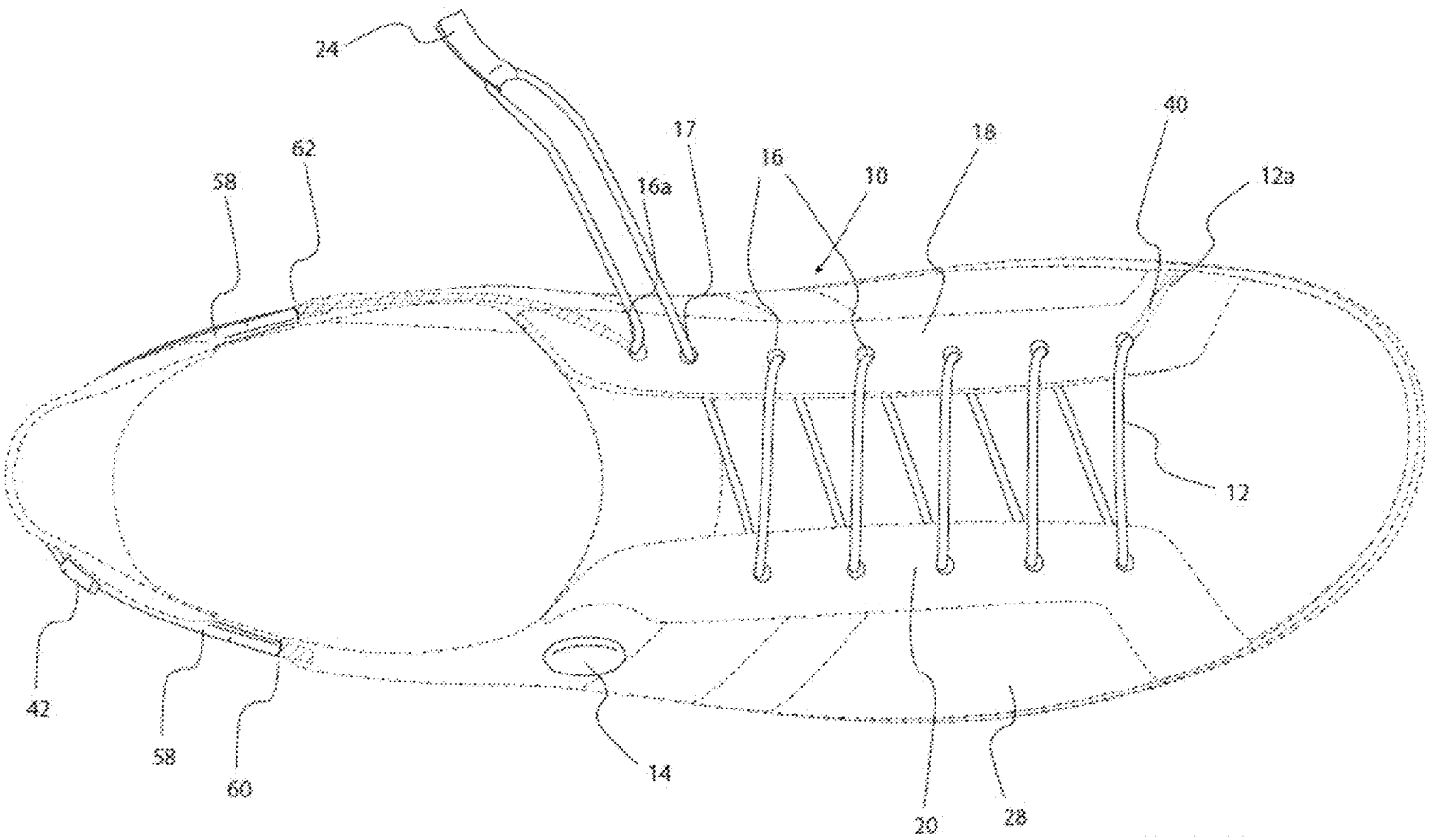
FIG. 14 is a top view of the shoe utilizing the closure system shown in FIG. 13 in which the shoelace is utilized.
Figure 15:
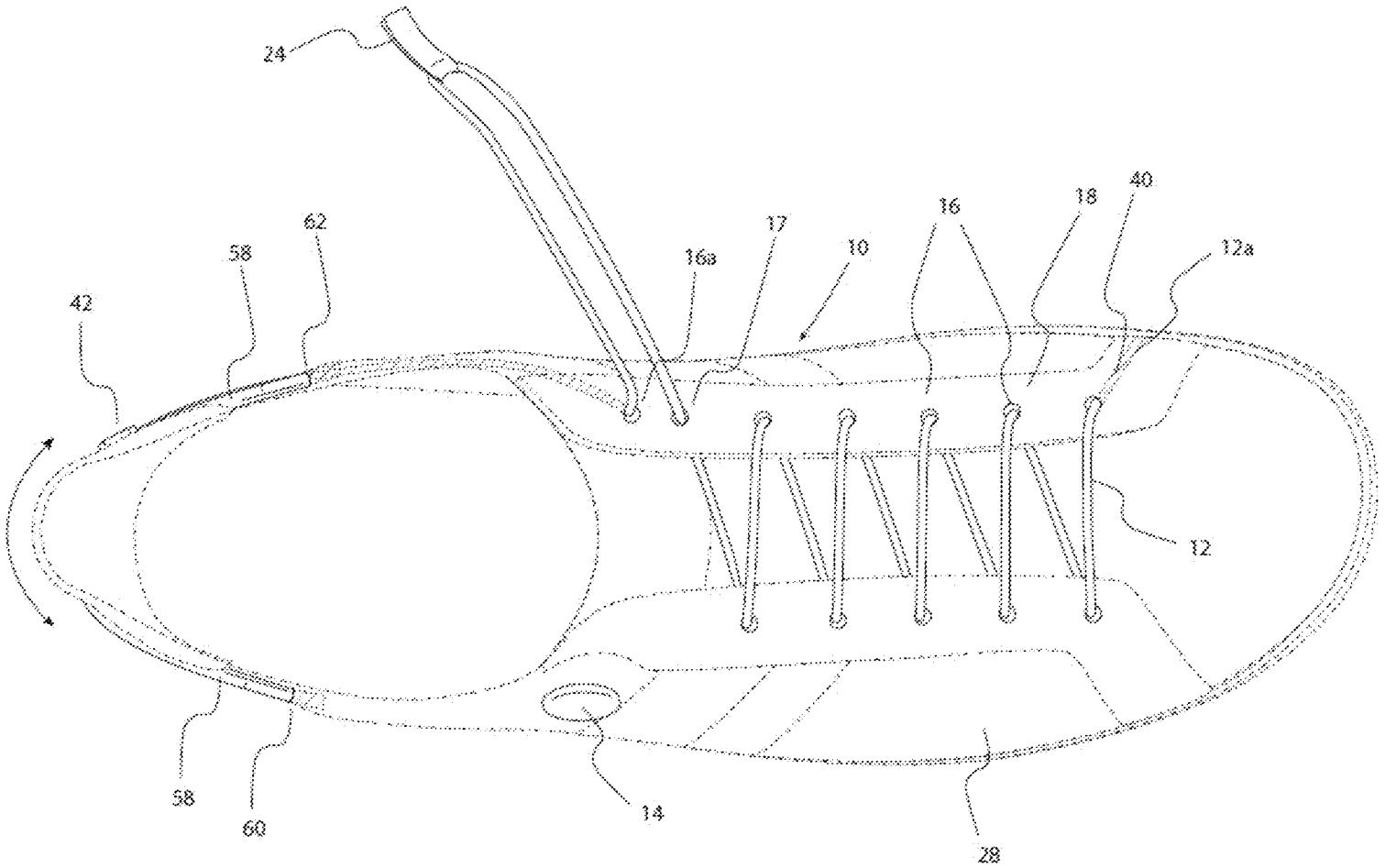
FIG. 15 is a top view of the shoe utilizing the closure system shown in FIG. 13 with the slider adjusted from the location of FIG. 14.
Figure 16:
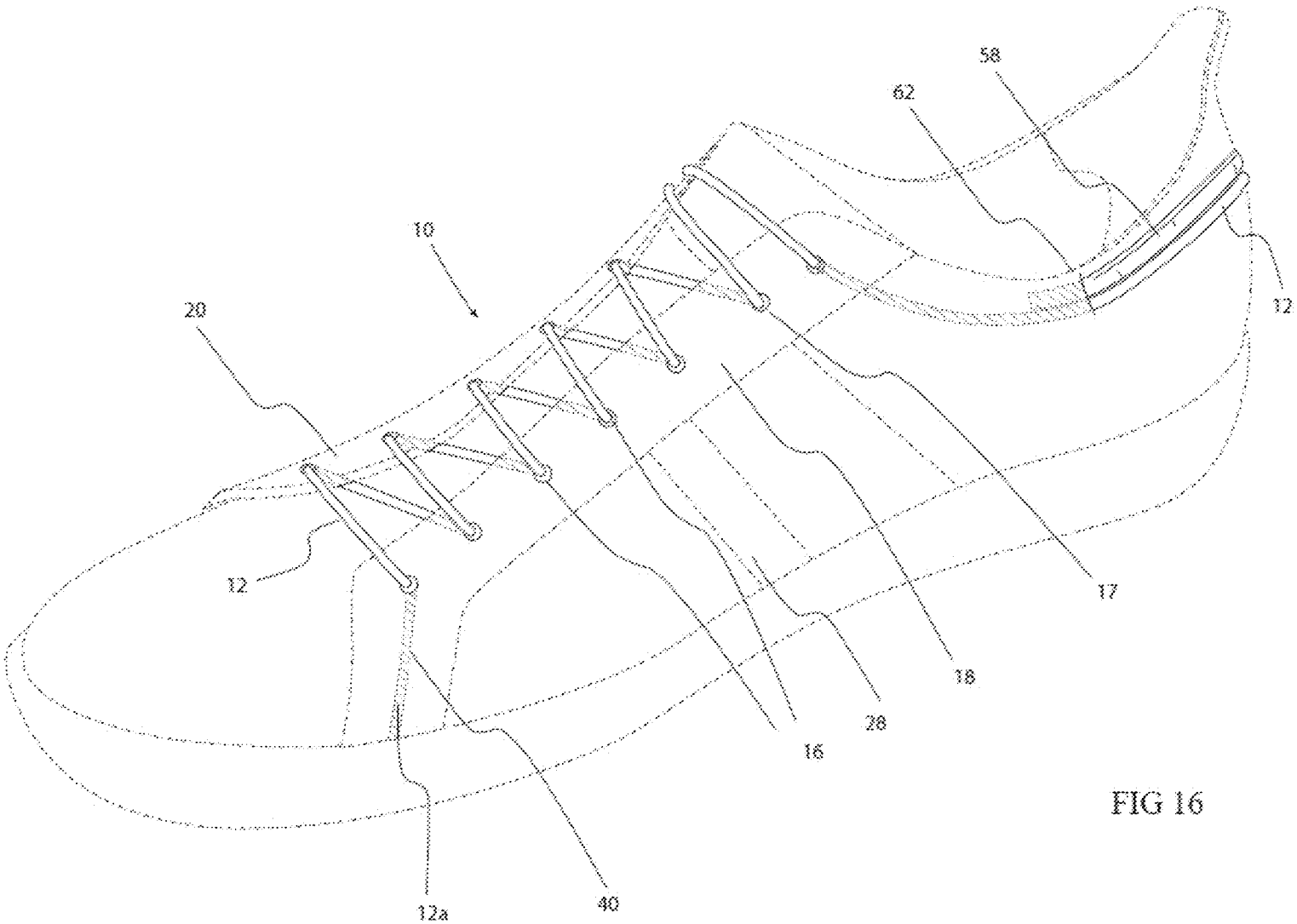
FIG. 16 is a medial side perspective view of the shoe utilizing the closure system shown in FIG. 23.
Figure 17:
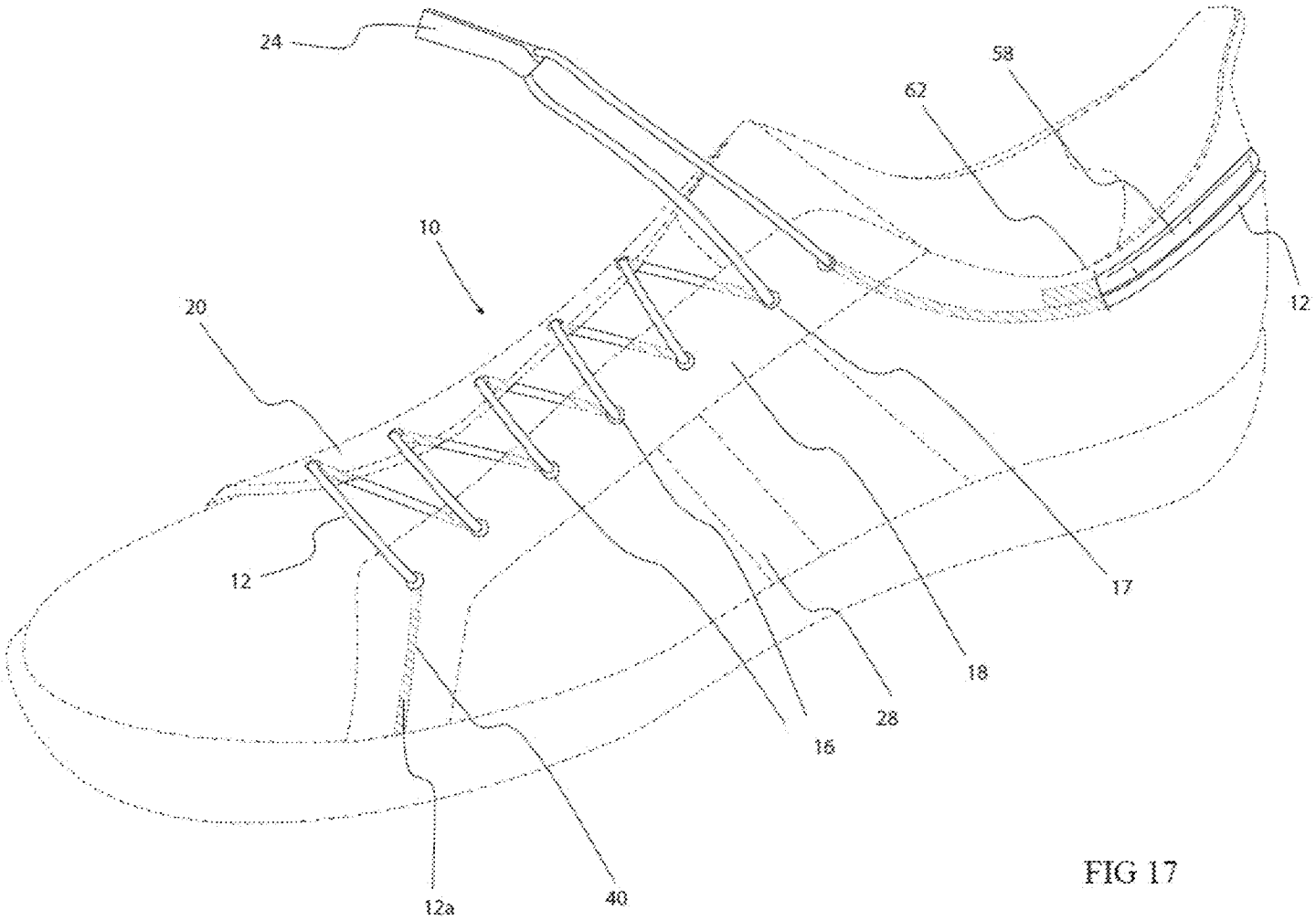
FIG. 17 is a medial side perspective view of the shoe utilizing the closure system shown in FIG. 23 with the shoelace in an unsecured position.
Figure 18:
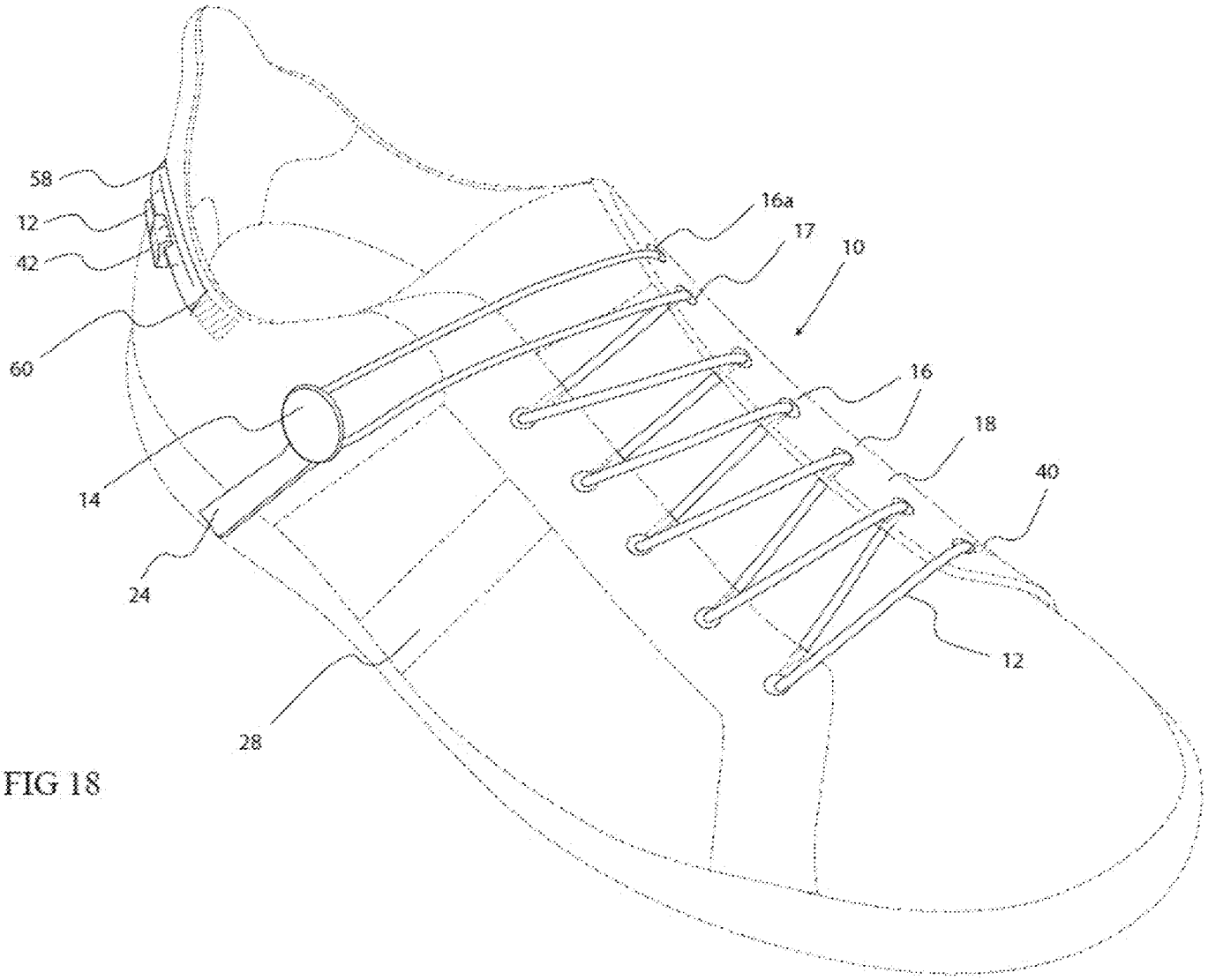
FIG. 18 is a lateral side view as the shoe shown in FIG. 23.
Figure 20:
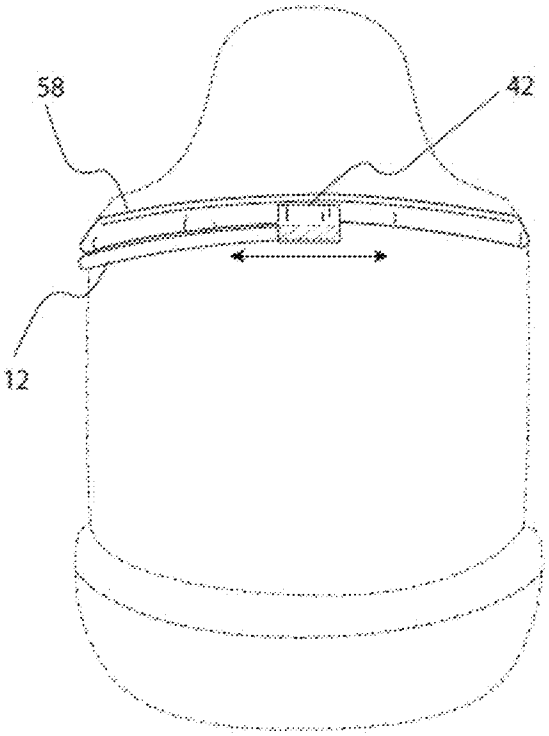
FIG. 20 is a rear elevational view of a shoe utilizing the closure system shown in FIG. 23.
Figure 19:
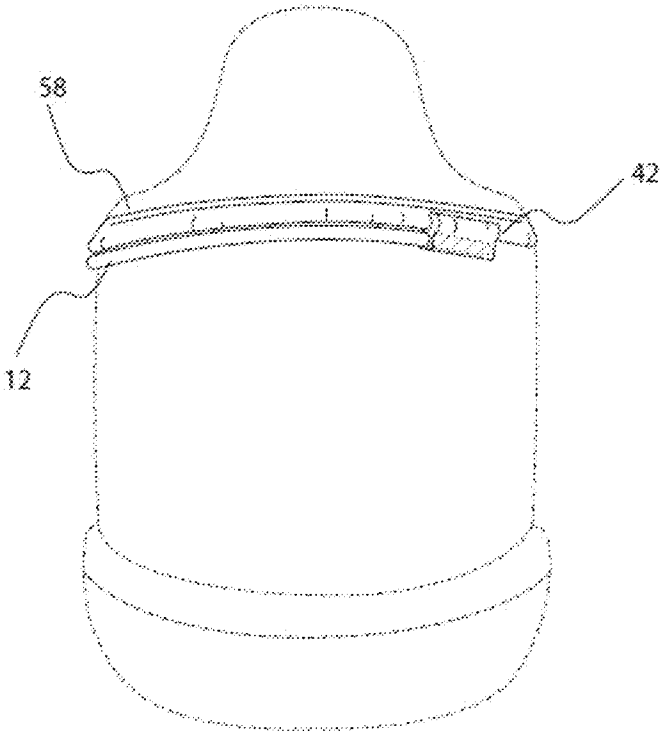
FIG. 19 is a rear elevational perspective view of a shoe utilizing the closure system shown in FIG. 23.
Figure 21:
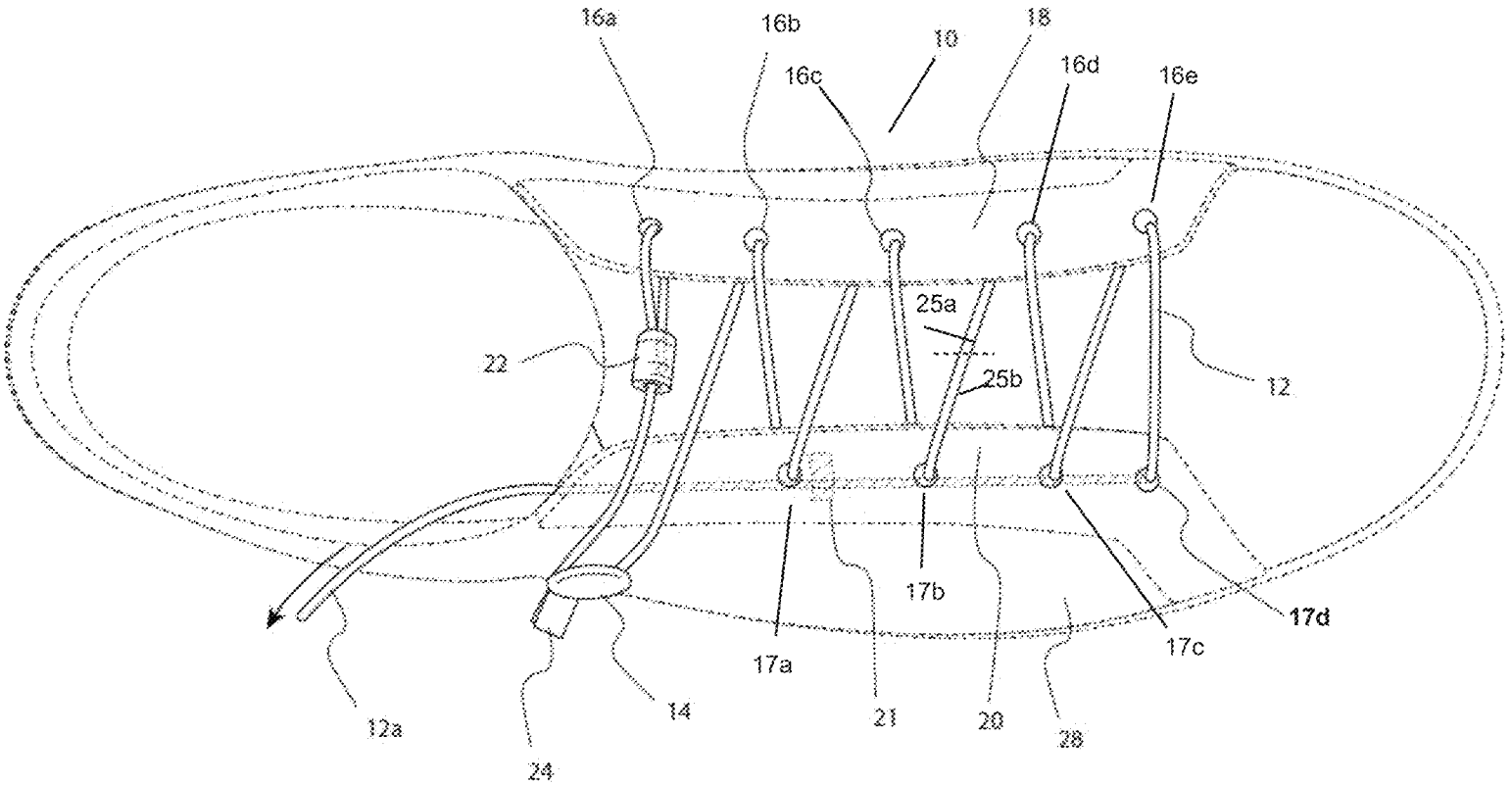
FIG. 21 is a top view of a shoe utilizing another embodiment of the closure system of the present invention with an untucked shoelace.
Figure 22:
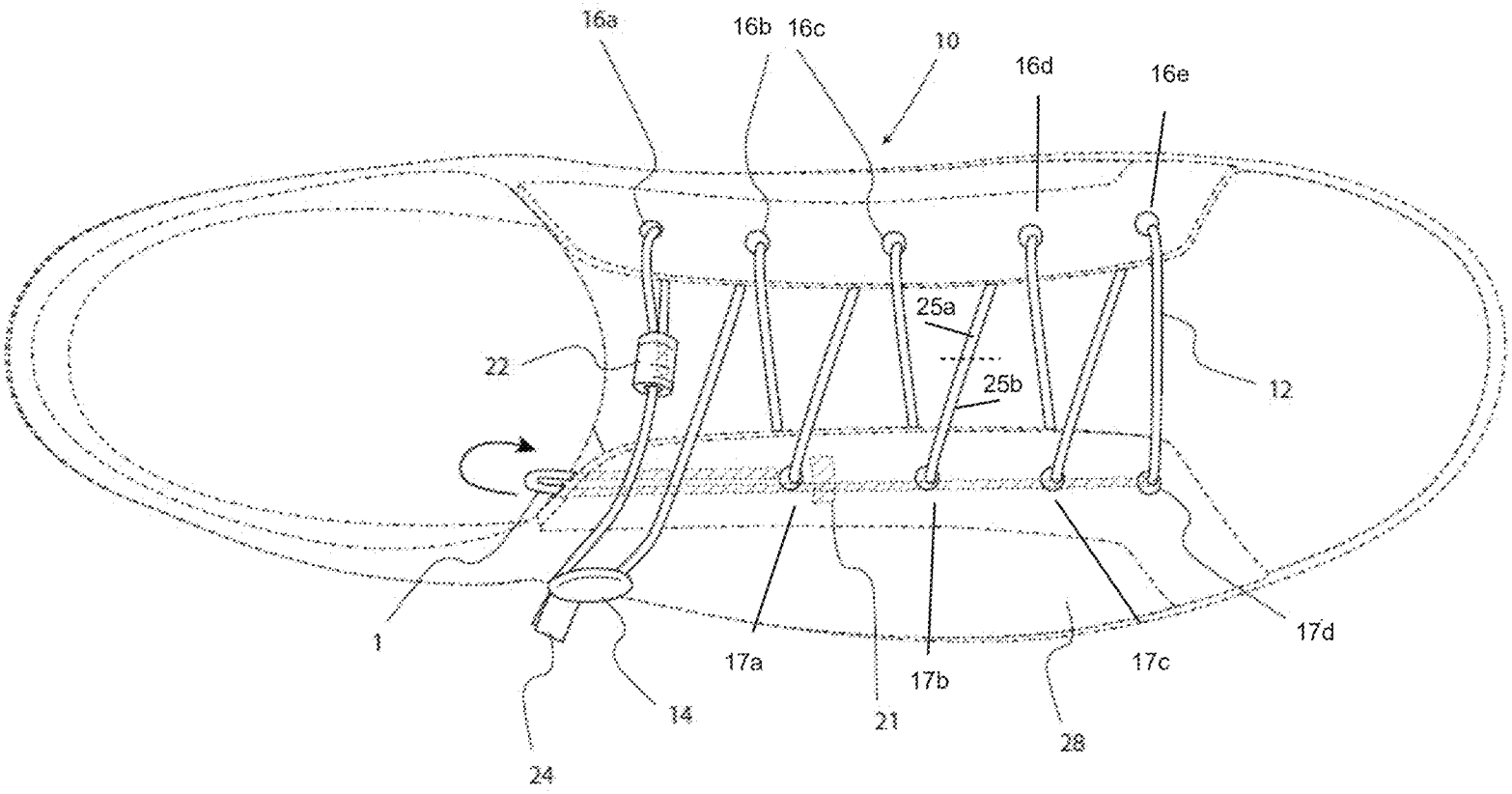
FIG. 22 is a top view of a shoe utilizing the closure system shown in FIG. 21 with the shoelace in a tucked position.
Figure 23:
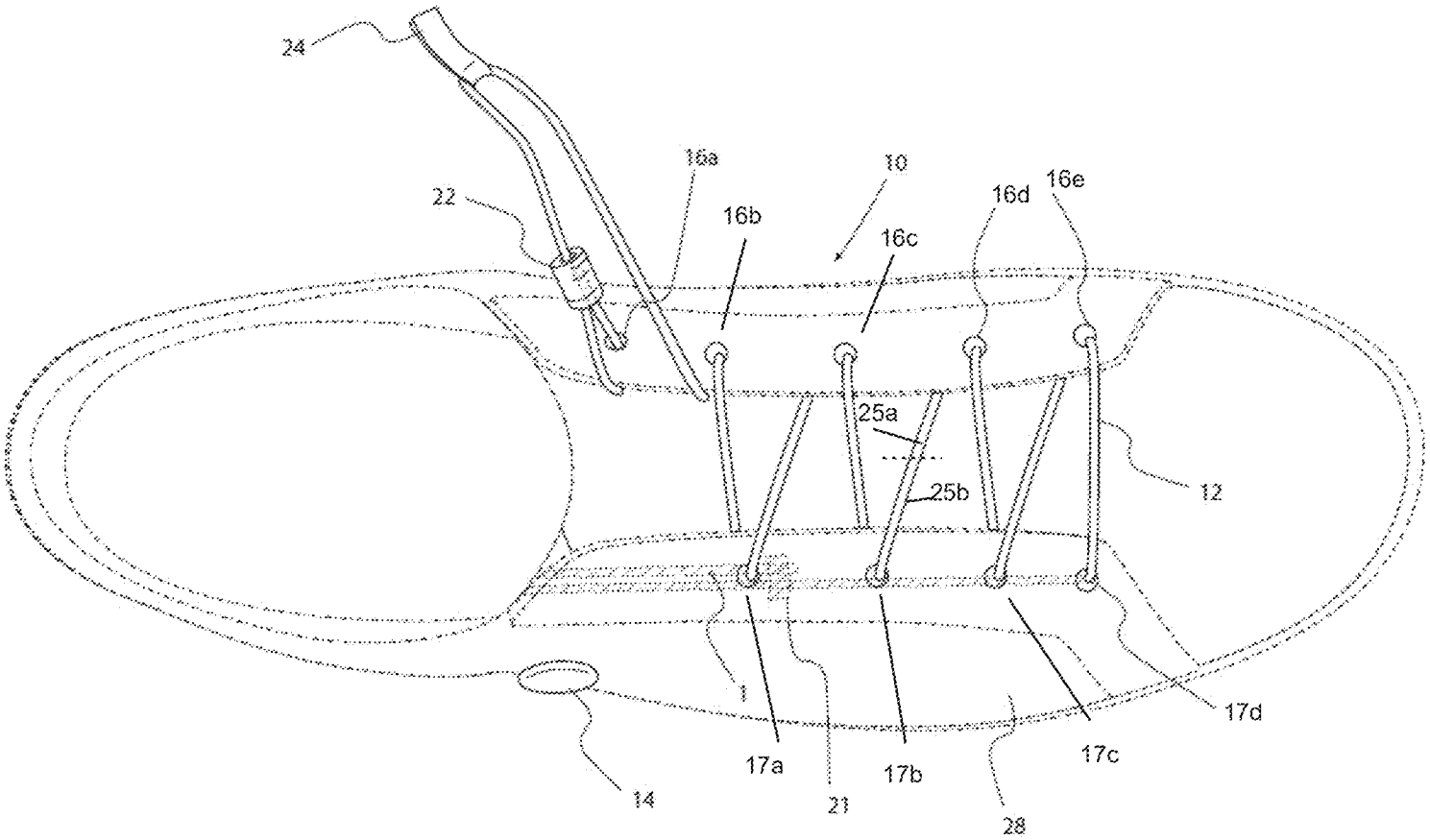
FIG. 23 is a top view of the shoe utilizing the closure system shown in FIG. 21 with the shoelace anchor being loosened.

In the embodiment of FIGS. 13-20, the piping 58 is secured under the upper 28 on each side of the shoe 10 through openings 60,62 in shoe 10. As shown in FIG. 13A, the lace can be crimped onto itself in the same manner as shown in FIG. 1A. In this embodiment, a slider 42 with a slightly different cross section than used in the embodiment of FIGS. 1-8 (and shown in FIG. 12A) may be used as shown in FIG. 12B to be inserted around the piping 58.

Figure 24:
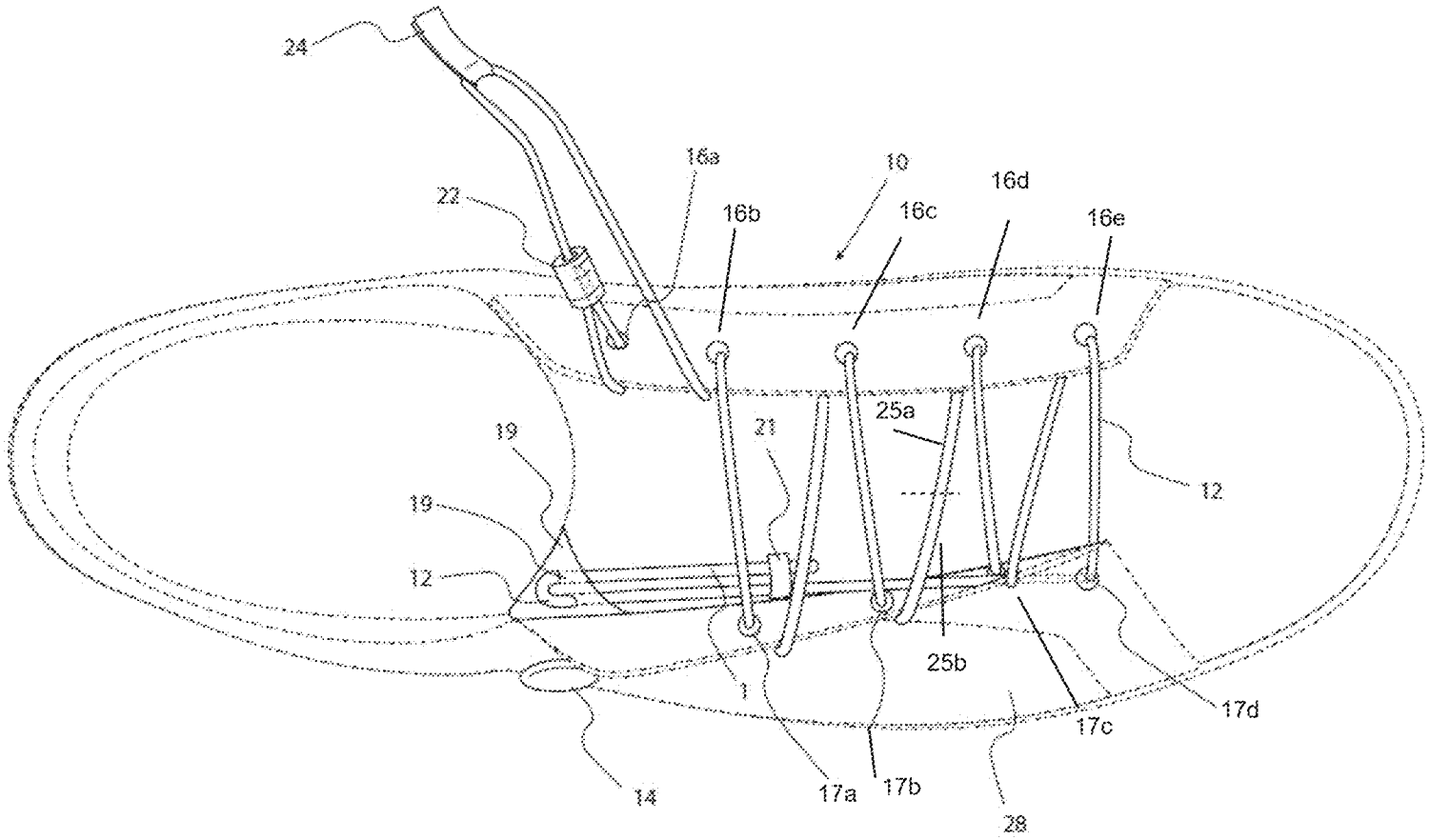
FIG. 24 is a top view of the shoe utilizing the closure system shown in FIG. 21 with the shoelace anchor being loosened and the lateral eyebrow being peeled over to reveal the lace keepers on the lateral/open side of the radial tongue.
Figure 25:
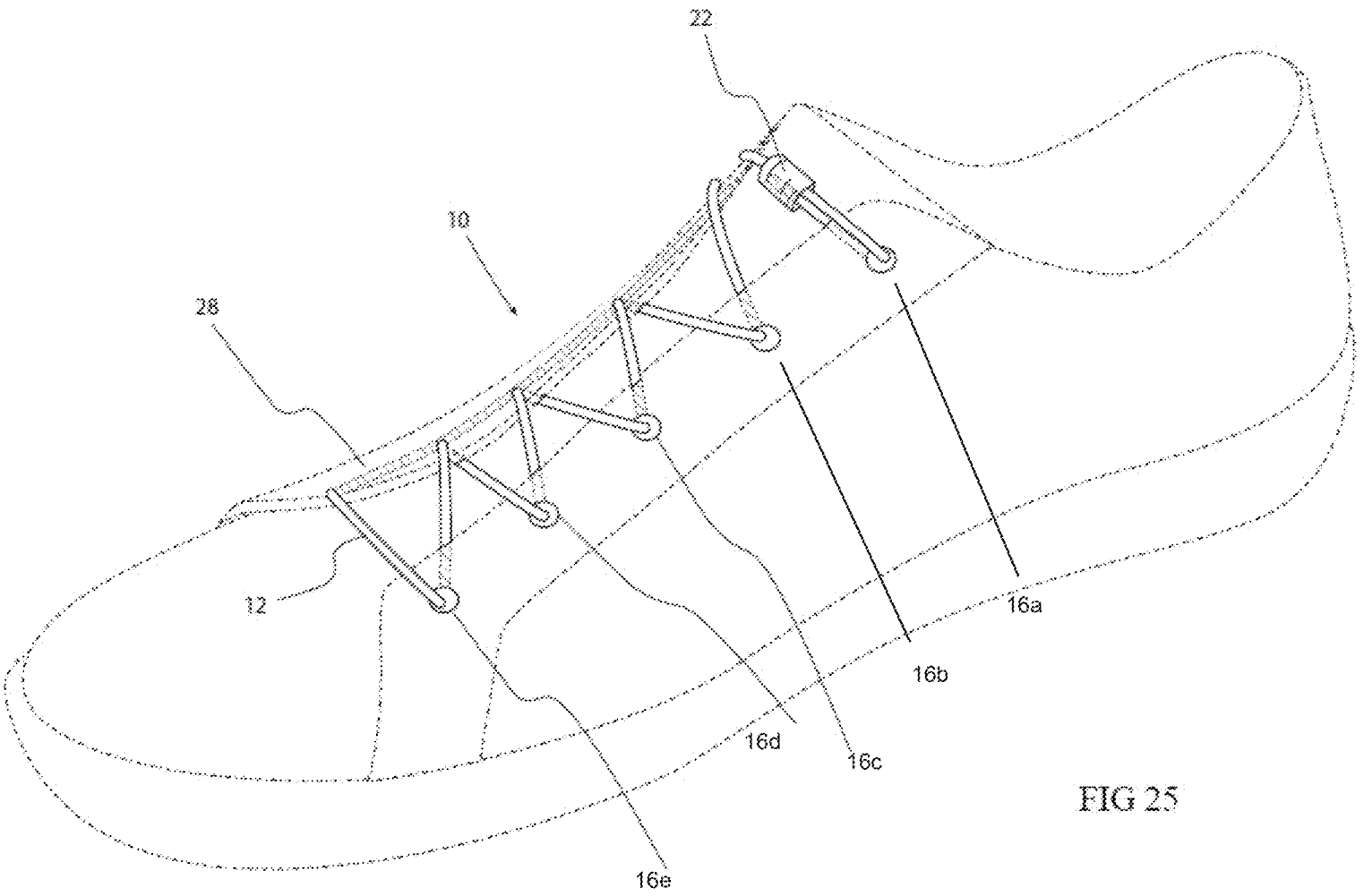
FIG. 25 is a side perspective view of the shoe utilizing the closure system of FIG. 21.
Figure 26:
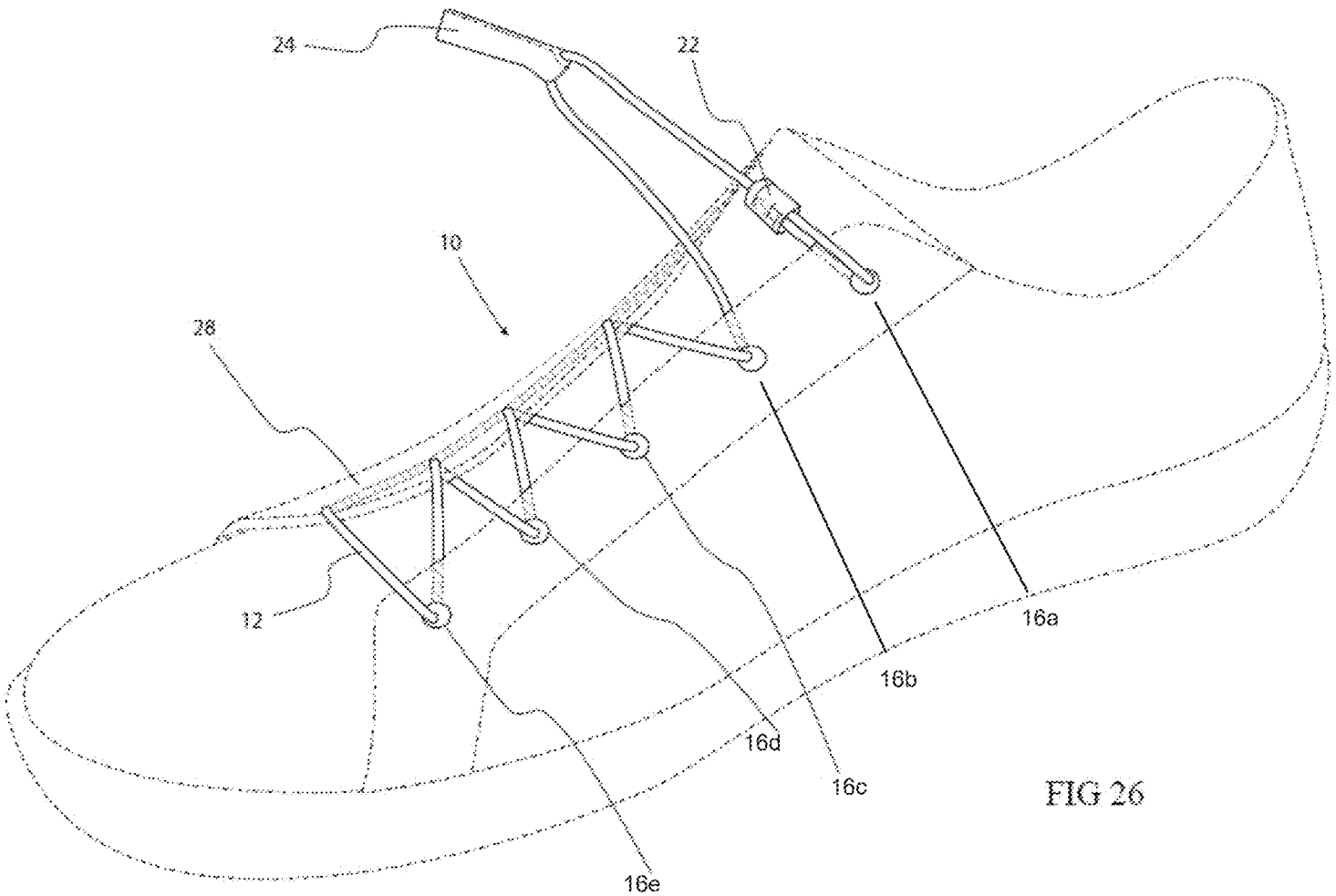
FIG. 26 is a medial side perspective view of the shoe utilizing the closure system shown in FIG. 21 with the shoelace in an unfastened state.
Figure 27:
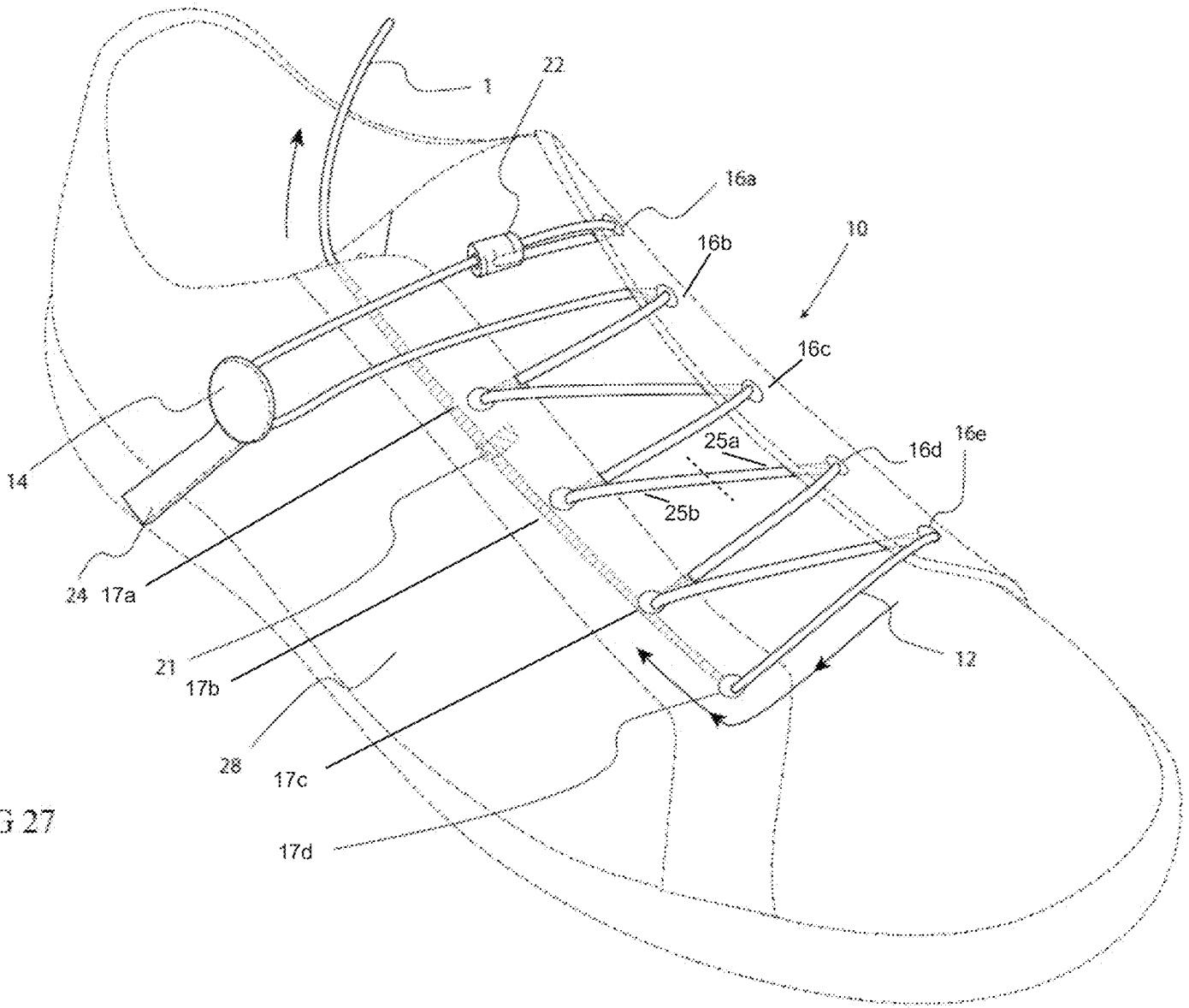
FIG. 27 is a top perspective view as the shoe shown in FIG. 21 with the shoelace in a fastened position without the end of the shoelace being tucked in the shoe.
Figure 28:
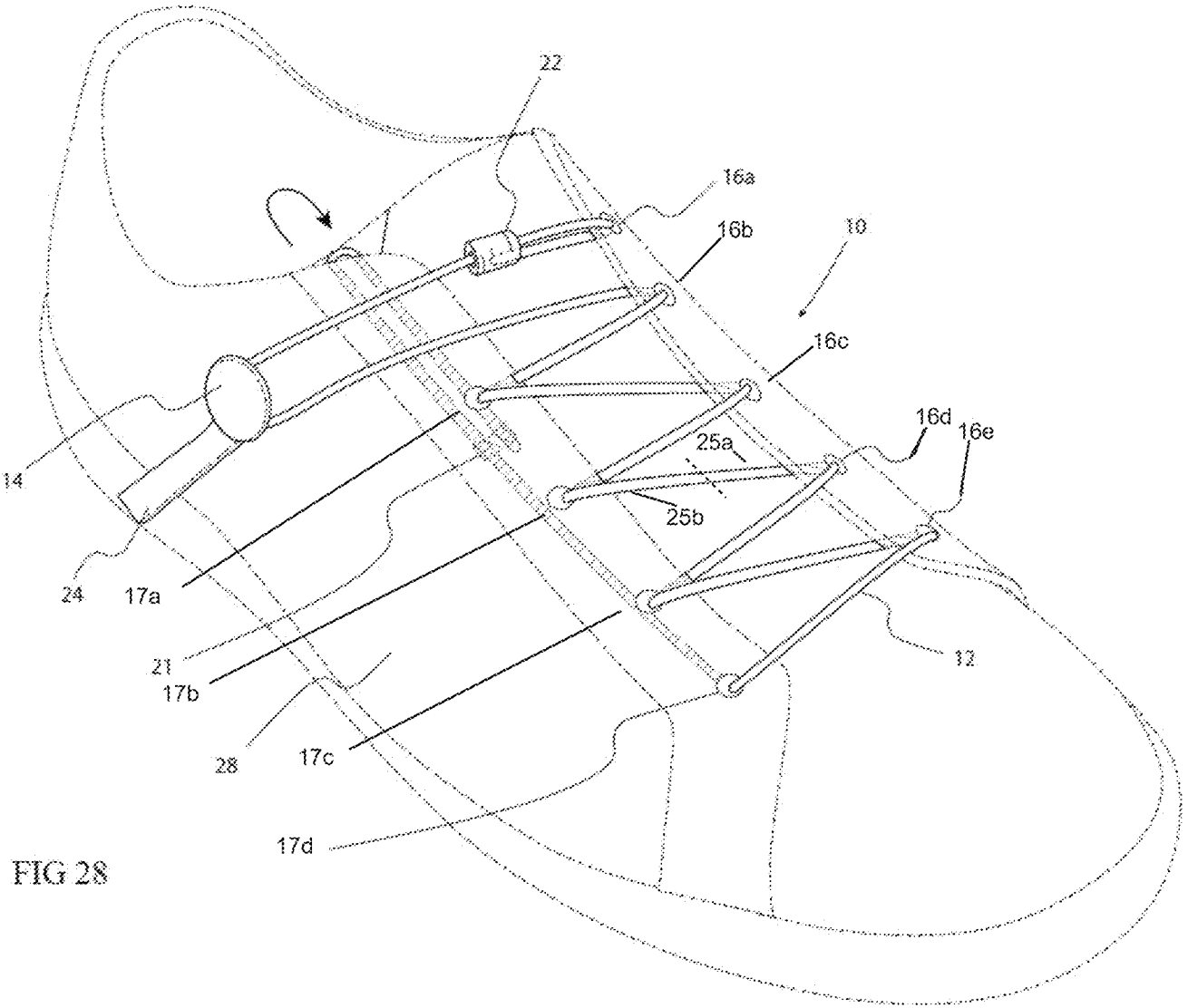
FIG. 28 is a top perspective view of a shoe utilizing the closure system shown in FIG. 27, with the end of the shoelace in a tucked position.

Referring to FIGS. 21-29, a shoe 10 is shown with another embodiment of a closure system that utilizes a single shoelace 12. The shoelace 12 is also inserted in the shoe 10 as a single strand. One end (not visible in the figures) of the shoelace 12 is glued in a barrel 22 that acts as a friction slide. Such fixed end of shoelace 12 could also be compressed in the barrel 22 as well. Shoe 10 includes a medial flap 18 comprising a first series of eyelets 16*a*-16*d* and a lateral flap 20 comprising a second series of eyelets 17*a*-17*d*. A first portion 25*a* of shoelace 12 includes first end 12*a* of shoelace 12 and extends to midway between eyelets 16*d* and 17*b*. A second portion 25*b* of shoelace 12 includes the end of the shoelace (not visible) that is glued in barrel 22 and extends from barrel 22 to midway between eyelet 16*d* and 17*b*. The shoelace 12 is then threaded through the eyelet 16*a* closest to where a wearer's foot is inserted into the shoe on the flap 18 on the medial side of the shoe 10. The shoelace 12 is then threaded back through the barrel 22 so that the portion of the shoelace 12 that is threaded back through the barrel 22 is slideably fit in barrel 22. A remainder of the second portion 25*b* of shoelace 12 is threaded through eyelet 16*b* such that it is threaded through eyelets 16*a* and 16*b* in immediate succession, thereby defining a single loop of shoelace 12 extending from eyelet 16*a* to eyelet 16*b*. A shoelace pull 24 is secured to the shoelace 12 at a location along second portion of the shoelace 12 after it passes through the barrel 22. While leaving some slack in the shoelace 12 to enable the shoelace 12 to be pulled around button 14, the shoelace 12 is then threaded alternately through the eyelets 16 on opposite sides of the shoe until it passes from the top of flap 20 through eyelet 16*b*. More specifically, eyelets 16*b*, 17*a*, 16*c*, and 17*b* define a first sequence of eyelets from among the first series of eyelets 16*a*-16*d* and the second series of eyelets 17*a*-17*e*, wherein eyelets 16*b*. 17*a*. 16*c*. 17*b* sequentially alternate between an eyelet from the first series and an eyelet in the second series, i.e., in the first sequence eyelet 16*b* is in the first series and is followed by eyelet 17*a* (second series), which is followed by eyelet 16*c* (first series), which is followed by eyelet 17*b* (second series). Similarly, eyelets 16*d*, 17*c*, 16*e*, and 17*d* define a second sequence of eyelets from among the first series and second series, wherein eyelets 16*d*. 17*c*, 16*e*, and 17*d* sequentially alternate between an eyelet in the first series and an eyelet in the second series, i.e., in the second sequence eyelet 16*d* is in the first series and is followed by eyelet 17*c* (second series), which is followed by eyelet 16*e* (first series), which is followed by eyelet 17*d* (second series). A remainder of the first portion of shoelace 12 is then threaded under flap 20 for the length of flap 20. Once the shoelace 12 has been adjusted, free end 12*a* of shoelace 12 is then tucked under flap 20 and through lace keepers 19 and 21 (as shown in FIG. 24), which secure the shoelace 12 under flap 20. As a result, free end 12*a* of the shoelace 12 is tucked out of sight in a position where it is held in place by friction. Other methods of securing the lace by friction will also keep the shoe in a closed state. For example, one could loop the end 12*a* of the lace through eyelet 17*d* twice and then tie the excess of the lace to itself, or trim it. Another would be lacing the loose end 12*a* back through the eyelets until the slack is taken up. While these are not preferred mechanisms, they will apply the necessary friction.

Figure 29:
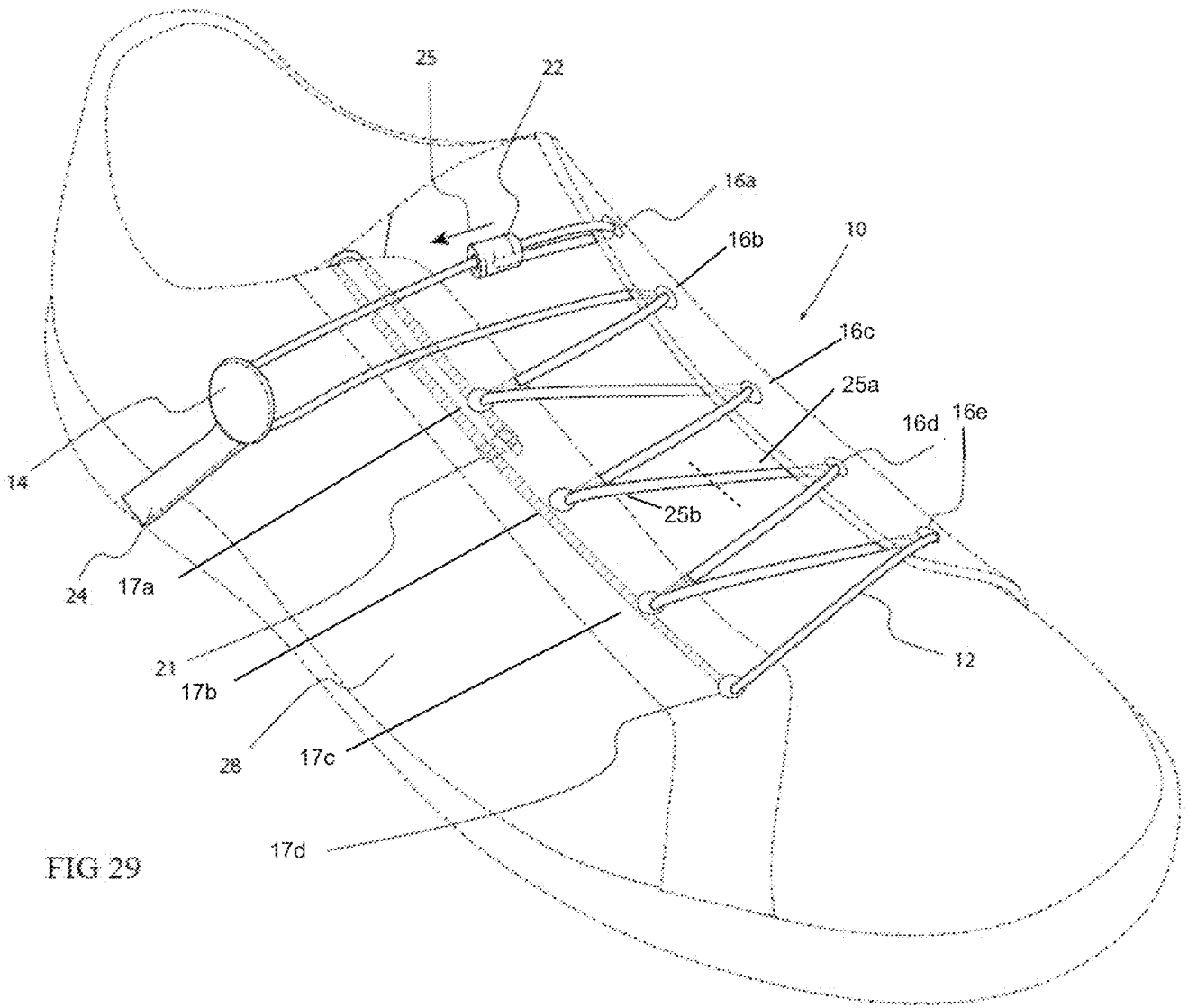
FIG. 29 is a top perspective view of a shoe utilizing the closure system shown in FIG. 27, illustrating the mechanism used for making micro-adjustments.

A lace pull 24 is secured to shoelace 12 to make it easy to pull the shoelace 12 over button 14. For a wearer of the shoe, once the macro adjustment of the tightening of the shoe 10 is made by the pulling of end 12*a* of shoelace 12 and tucking the shoelace 12 away, the user can make micro adjustments of the fit of the shoe 10 by sliding barrel 22 as shown in FIG. 29. The direction of the arrow 25 next to barrel 22 in FIG. 29 indicates a tightening of the shoe 10 when the barrel is moved in the direction of the arrow 25. If the barrel is moved in the opposite direction, there is a micro loosening adjustment on the tension of the shoelace 12.

The shoelace 12 in all of the embodiments can be made of either a static or a dynamic material. When it is made of a dynamic material, it can be more easily stretched to be pulled over button 14. The shoelace 12 is preferably approximately 2 mm cord. Other sizes could be used as long as the shoelace 12 is strong enough to withstand the force and tension from pull and wear but no so thick as to cause irritation when the shoelace 12 is tucked under flap 20.

The foregoing invention has been described with reference to its preferred embodiments. Various alterations and modifications will occur to those skilled in the art. All such alterations and modifications are intended to fall within the scope of the appended claims.

What is claimed is:

1. A shoe closure system for use with a shoe comprising:

first and second flaps with the first flap positioned on a first side of the shoe and the second flap positioned on a second side of the shoe opposite the first side of the shoe;

a first series of eyelets in said first flap and a second series of eyelets in said second flap;

a shoelace having a length sufficient to be threaded alternately between eyelets in said first series of eyelets and eyelets in said second series of eyelets;

a first end of said shoelace being securely fixed in a sliding barrel, a second end of said shoelace being threaded through a top eyelet on a first flap of said two flaps and then back through said sliding barrel, said shoelace also being alternately threaded through eyelets in both the first and second series of eyelets;

the second end of said shoelace being threaded under said second flap of said two flaps after said second end of said shoelace is alternately threaded through said eyelets; and whereby said second end of said shoelace can be pulled to tighten said shoe and can be tucked under said second flap, and wherein when the second end of said shoelace is tucked under said second flap, the sliding barrel is slidable along a portion of the shoelace to adjust a position of the first end of the shoelace relative to the second flap to tighten or loosen the shoe.

2. The shoe closure system of claim 1 further comprising a first lace keeper under said second flap for receiving said shoelace tucked under said second flap.

3. The shoe closure system of claim 1 further comprising a button secured to an upper of said shoe and wherein said shoelace is capable of being secured around said button.

4. The shoe closure system of claim 3 wherein said button includes a top button and a base button, said top button being removably secured to said base button.

5. A shoe comprising:

an upper having a first side and a second side spaced apart along a lateral-medial axis, a first flap on the first side of the upper, a second flap on the second side of the upper, wherein the first flap is spaced apart from the second flap along the lateral-medial axis, the first flap having a first series of eyelets extending along a length axis of the shoe, and the second flap having a second series of eyelets extending along the length axis of the shoe, wherein the second series of eyelets includes a first eyelet closest along the length axis to an opening of the upper configured for insertion of a wearer's foot and a second eyelet adjacent the first eyelet along the length axis;

a shoe lace having a first portion comprising a first end of the shoelace and a second portion comprising a second end of the shoelace, the first portion of the shoelace being laced through a first sequence of eyelets from among eyelets in the first series of eyelets and the second series of eyelets, wherein the eyelets in the first sequence of eyelets sequentially alternate between an eyelet from the first series of eyelets and an eyelet from the second series of eyelets, the first end of the shoelace being secured on the first side of the shoe, the second portion of the shoelace being laced through a second sequence of eyelets in the first series of eyelets and the second series of eyelets, wherein the eyelets in the second sequence of eyelets sequentially alternate between an eyelet from the first series of eyelets and an eyelet from the second series of eyelets, the second portion of the shoe lace further being laced through the first eyelet and the second eyelet in the second series of eyelets to define a single loop extending from the first eyelet in the second series of eyelets to the second eyelet in the second series of eyelets, wherein the single loop is pullable past the first series of eyelets in a direction from the second side of the upper to the first side of the upper along the lateral-medial axis to tighten the shoe, wherein the first end of the shoelace is tucked under said first flap, the second end of the shoelace is securely fixed in a sliding barrel, the sliding barrel being slidable along a portion of the shoelace, and the sliding barrel is slidable along a portion of the shoelace to adjust a position of the second end of the shoelace relative to the first flap to tighten or loosen the shoe.

6. The shoe of claim 5, wherein the first eyelet and the second eyelet in the second series of eyelets are spaced apart along the length axis without an intervening eyelet between the first eyelet and the second eyelet in the second series of eyelets.

7. The shoe of claim 5, further comprising a first lace keeper under the first flap, wherein the first lace keeper is configured to retain said first end of said shoelace under said first flap.

8. The shoe of claim 7, further comprising a second lace keeper positioned under said first flap and between respective locations of two eyelets in the first series of eyelets.

9. A shoe comprising:

an upper having a first side and a second side spaced apart along a lateral-medial axis, a first flap on the first side of the upper, a second flap on the second side of the upper, wherein the first flap is spaced apart from the second flap along the lateral-medial axis, the first flap having a first series of eyelets extending along a length axis of the shoe, and the second flap having a second series of eyelets extending along the length axis of the shoe, wherein the second series of eyelets includes a first eyelet closest along the length axis to an opening of the upper configured for insertion of a wearer's foot and a second eyelet adjacent the first eyelet along the length axis;

a shoe lace having a first portion comprising a first end of the shoelace and a second portion comprising a second end of the shoelace, the first portion of the shoelace being laced through a first sequence of eyelets from among eyelets in the first series of eyelets and the second series of eyelets, wherein the eyelets in the first sequence of eyelets sequentially alternate between an eyelet from the first series of eyelets and an eyelet from the second series of eyelets, the first end of the shoelace being secured on the first side of the shoe, the second portion of the shoelace being laced through a second sequence of eyelets in the first series of eyelets and the second series of eyelets, wherein the eyelets in the second sequence of eyelets sequentially alternate between an eyelet from the first series of eyelets and an eyelet from the second series of eyelets, the second portion of the shoe lace further being laced through the first eyelet and the second eyelet in the second series of eyelets to define a single loop extending from the first eyelet in the second series of eyelets to the second eyelet in the second series of eyelets, wherein the single loop is pullable past the first series of eyelets in a direction from the second side of the upper to the first side of the upper along the lateral-medial axis to tighten the shoe;

a button secured to the first side of the upper of the shoe, wherein the single loop is capable of being stretched to be pulled over the button, wherein the first flap is located between the button and the second flap along the lateral-medial axis, and the first series of eyelets is located between the button and the second flap along the lateral-medial axis.

10. The shoe of claim 9, wherein the button includes a top button and a base button, the top button being removably secured to the base button.

* * * * *